US010206530B2

(12) United States Patent
Chen

(10) Patent No.: US 10,206,530 B2
(45) Date of Patent: Feb. 19, 2019

(54) MODULAR TREE WITH LOCKING TRUNK

(71) Applicant: Willis Electric Co., Ltd., Taipei (TW)

(72) Inventor: Johnny Chen, Taipei (TW)

(73) Assignee: Willis Electric Co., Ltd., Taipei (TW)

( * ) Notice: Subject to any disclaimer, the term of this patent is extended or adjusted under 35 U.S.C. 154(b) by 859 days.

(21) Appl. No.: 13/804,090

(22) Filed: Mar. 14, 2013

(65) Prior Publication Data

US 2013/0301245 A1 Nov. 14, 2013

Related U.S. Application Data

(60) Provisional application No. 61/680,927, filed on Aug. 8, 2012, provisional application No. 61/643,968, filed on May 8, 2012.

(51) Int. Cl.
*A41G 1/00* (2006.01)
*A47G 33/06* (2006.01)

(52) U.S. Cl.
CPC ..... *A47G 33/06* (2013.01); *A41G 1/005* (2013.01)

(58) Field of Classification Search
None
See application file for complete search history.

(56) References Cited

U.S. PATENT DOCUMENTS

| | | | |
|---|---|---|---|
| 438,310 | A | 10/1890 | Edison |
| 735,010 | A | 7/1903 | Zahl |
| 860,406 | A | 7/1907 | McGahan |
| 1,314,008 | A | 8/1919 | McWilliams |
| 1,495,695 | A | 5/1924 | Karr |
| 1,536,332 | A | 5/1925 | Dam |
| 1,656,148 | A | 1/1928 | Harris |
| 1,677,972 | A | 7/1928 | Marks |
| 1,694,974 | A | 12/1928 | Glover |
| 1,895,656 | A | 1/1933 | Gadke |
| 1,974,472 | A | 9/1934 | Seghers |
| 2,025,189 | A | 12/1935 | Yanchenko |
| 2,050,364 | A | 8/1936 | Morton |
| 2,072,337 | A | 3/1937 | Kamm |

(Continued)

FOREIGN PATENT DOCUMENTS

| | | | |
|---|---|---|---|
| CA | 1182513 | A | 2/1985 |
| CN | 2102058 | U | 4/1992 |

(Continued)

OTHER PUBLICATIONS

U.S. Appl. No. 12/157,136, filed Jun. 5, 2008, inventor Johnny Chen.

(Continued)

*Primary Examiner* — Britt D Hanley
(74) *Attorney, Agent, or Firm* — Christensen, Fonder, Dardi & Herbert PLLC

(57) ABSTRACT

A tree trunk system for an artificial decorative tree includes a first trunk body defining a first central axis extending from a distal end to a proximal end, the distal end having an insertable portion defining a plurality of channels, and a second trunk body having a proximal end configured to receive the insertable portion of the first trunk body and having a protuberance extending radially inward. When the trunk bodies are coupled, thereby preventing rotation of the first trunk body relative the second trunk body, about the common central axis.

19 Claims, 10 Drawing Sheets

(56) References Cited

U.S. PATENT DOCUMENTS

| | | | |
|---|---|---|---|
| 2,112,281 | A | 3/1938 | Ferris |
| 2,188,529 | A | 3/1938 | Corina |
| 2,186,351 | A | 1/1940 | Stojaneck |
| 2,214,046 | A | 9/1940 | Doran |
| 2,466,499 | A | 4/1949 | Sokolik |
| 2,484,596 | A | 10/1949 | Waltz |
| 2,484,813 | A | 10/1949 | Waltz |
| 2,533,374 | A | 12/1950 | Hyland |
| 2,563,713 | A | 8/1951 | Frei et al. |
| 2,570,751 | A | 10/1951 | Benander |
| 2,636,069 | A | 4/1953 | Gilbert |
| 2,782,296 | A | 2/1957 | Walter |
| 2,806,938 | A | 9/1957 | Henry |
| 2,826,845 | A | 3/1958 | Warren |
| 2,826,846 | A | 3/1958 | Warren |
| 2,857,506 | A | 10/1958 | Minteer |
| 2,863,037 | A | 12/1958 | Johnstone |
| 2,932,811 | A | 4/1960 | Abraham et al. |
| 2,969,456 | A | 1/1961 | Raymaley |
| 2,973,546 | A | 3/1961 | Roche |
| 2,984,813 | A | 5/1961 | Bossi |
| 3,107,966 | A | 10/1963 | Bonhomme |
| 3,115,435 | A | 12/1963 | Abramson |
| 3,118,617 | A | 1/1964 | Helfrich |
| 3,120,351 | A | 2/1964 | Kirsten |
| 3,131,112 | A | 4/1964 | Abramson |
| 3,144,375 | A | 8/1964 | Day |
| 3,214,318 | A | 10/1965 | Snow |
| 3,214,579 | A | 10/1965 | Pacini |
| 3,233,207 | A | 2/1966 | Ahroni et al. |
| 3,234,073 | A | 2/1966 | Raymond et al. |
| 3,286,088 | A | 11/1966 | Ahroni |
| 3,296,430 | A | 1/1967 | Eckert |
| 3,345,482 | A | 10/1967 | Lou |
| 3,398,260 | A | 8/1968 | Martens |
| 3,470,527 | A | 9/1969 | Bonhomme |
| 3,504,169 | A | 3/1970 | Freeburger |
| 3,521,216 | A | 7/1970 | Tolegian |
| 3,522,579 | A | 8/1970 | Matsuya |
| 3,571,586 | A | 3/1971 | Duckworth |
| 3,574,102 | A | 4/1971 | Hermanson |
| 3,585,564 | A | 6/1971 | Skjervoll |
| 3,594,260 | A | 7/1971 | Smith |
| 3,603,780 | A | 9/1971 | Lu |
| 3,616,107 | A | 10/1971 | Kershner |
| 3,617,732 | A | 11/1971 | Fisher |
| 3,640,496 | A | 2/1972 | Duncan |
| 3,663,924 | A | 5/1972 | Gerlat |
| 3,704,366 | A | 11/1972 | Korb et al. |
| 3,715,708 | A | 2/1973 | Lloyd et al. |
| 3,728,787 | A | 4/1973 | McDonough |
| 3,764,862 | A | 10/1973 | Jankowski |
| 3,783,437 | A | 1/1974 | Graff et al. |
| 3,806,399 | A | 4/1974 | Cocjin |
| 3,812,380 | A | 5/1974 | Davis, Jr. |
| 3,819,459 | A | 6/1974 | Wren |
| 3,914,786 | A | 10/1975 | Grossi |
| 3,970,834 | A | 7/1976 | Smith |
| 3,971,619 | A | 7/1976 | Rohrssen |
| 3,985,924 | A | 10/1976 | Pritza |
| 4,012,631 | A | 3/1977 | Creager |
| 4,020,201 | A | 4/1977 | Miller |
| 4,045,868 | A | 9/1977 | Ammon et al. |
| 4,072,857 | A | 2/1978 | DeVicaris |
| 4,097,917 | A | 6/1978 | McCaslin |
| 4,109,345 | A | 8/1978 | Sargent et al. |
| 4,130,678 | A | 12/1978 | Higgins |
| 4,140,823 | A | 2/1979 | Weskamp |
| 4,161,768 | A | 7/1979 | Gauthier et al. |
| 4,245,875 | A | 1/1981 | Shaffer et al. |
| 4,248,916 | A | 2/1981 | Chase |
| 4,273,814 | A | 6/1981 | Koehler |
| 4,291,075 | A | 9/1981 | Puleo |
| 4,340,841 | A | 7/1982 | Schupp |
| 4,343,842 | A | 8/1982 | Chase |
| 4,437,782 | A | 3/1984 | Geisthoff |
| 4,447,279 | A | 4/1984 | Boisvert et al. |
| 4,451,510 | A | 5/1984 | Boisvert et al. |
| 4,462,065 | A | 7/1984 | Rhodes |
| 4,468,421 | A | 8/1984 | Wang |
| 4,493,523 | A | 1/1985 | Leong et al. |
| 4,496,615 | A | 1/1985 | Huang |
| 4,516,193 | A | 5/1985 | Murphy |
| 4,519,666 | A | 5/1985 | Williams et al. |
| 4,546,041 | A | 10/1985 | Keane et al. |
| 4,573,102 | A | 2/1986 | Norwood |
| 4,620,270 | A | 10/1986 | Laasko |
| 4,631,650 | A | 12/1986 | Ahroni |
| 4,659,597 | A | 4/1987 | Lau |
| 4,675,575 | A | 6/1987 | Smith et al. |
| 4,712,299 | A | 12/1987 | Loewen et al. |
| 4,720,272 | A | 1/1988 | Durand |
| 4,727,449 | A | 2/1988 | Fleck |
| 4,753,600 | A | 6/1988 | Williams |
| 4,759,729 | A | 7/1988 | Kemppainen et al. |
| 4,769,579 | A | 9/1988 | Jou |
| 4,772,215 | A | 9/1988 | Falk |
| 4,775,922 | A | 10/1988 | Engel |
| 4,777,573 | A | 10/1988 | Liao |
| 4,779,177 | A | 10/1988 | Ahroni |
| 4,789,570 | A | 12/1988 | Maddock |
| 4,799,902 | A | 1/1989 | Laudig et al. |
| 4,805,075 | A | 2/1989 | Damore |
| 4,807,098 | A | 2/1989 | Ahroni |
| 4,808,885 | A | 2/1989 | Bausch et al. |
| 4,855,880 | A | 8/1989 | Mancusi, Jr. |
| 4,859,205 | A | 8/1989 | Fritz |
| 4,867,690 | A | 9/1989 | Thumma |
| 4,870,547 | A | 9/1989 | Crucefix |
| 4,870,753 | A | 10/1989 | Pfeffer et al. |
| 4,894,019 | A | 1/1990 | Howard |
| 4,899,266 | A | 2/1990 | Ahroni |
| 4,908,743 | A | 3/1990 | Miller |
| 4,921,426 | A | 5/1990 | Kawasaki et al. |
| 4,934,964 | A | 6/1990 | Mazelle |
| 5,015,510 | A | 5/1991 | Smith |
| 5,033,976 | A | 7/1991 | Sarian et al. |
| 5,051,877 | A | 9/1991 | Liao |
| 5,071,362 | A | 12/1991 | Martens et al. |
| 5,073,132 | A | 12/1991 | Nottrott |
| 5,088,669 | A | 2/1992 | Zinnbauer |
| 5,091,834 | A | 2/1992 | Kao et al. |
| 5,104,608 | A | 4/1992 | Pickering |
| 5,109,324 | A | 4/1992 | Ahroni |
| 5,121,310 | A | 6/1992 | Ahroni |
| 5,139,343 | A | 8/1992 | Lin |
| 5,149,282 | A | 9/1992 | Donato et al. |
| 5,154,508 | A | 10/1992 | Ahroni |
| 5,213,407 | A | 5/1993 | Eisenbraun |
| 5,217,382 | A | 6/1993 | Sparks |
| 5,218,233 | A | 6/1993 | Takahashi |
| 5,281,158 | A | 1/1994 | Lin |
| 5,334,025 | A | 8/1994 | Föhl |
| 5,342,661 | A | 8/1994 | Wilcox, II |
| 5,349,780 | A | 9/1994 | Dyke |
| 5,350,315 | A | 9/1994 | Cheng et al. |
| 5,366,386 | A | 11/1994 | Liao |
| 5,380,215 | A | 1/1995 | Huang |
| 5,389,008 | A | 2/1995 | Cheng et al. |
| 5,390,463 | A | 2/1995 | Sollner |
| D356,246 | S | 3/1995 | Adams |
| 5,409,403 | A | 4/1995 | Falossi et al. |
| 5,409,745 | A | 4/1995 | McGuire |
| 5,422,766 | A | 6/1995 | Shu |
| 5,442,258 | A | 9/1995 | Shibata |
| 5,453,664 | A | 9/1995 | Harris |
| 5,455,750 | A | 10/1995 | Davis et al. |
| 5,456,620 | A | 10/1995 | Kaminski |
| 5,481,444 | A | 1/1996 | Schultz |
| D367,257 | S | 2/1996 | Buelow et al. |
| 5,517,390 | A | 5/1996 | Zins |
| 5,518,425 | A | 5/1996 | Tsai |
| 5,536,538 | A | 7/1996 | Hartung |
| 5,541,818 | A | 7/1996 | Ng et al. |

(56) References Cited

U.S. PATENT DOCUMENTS 5,550,720 A 8/1996 Carroll
5,559,681 A 9/1996 Duarte
5,560,975 A 10/1996 Casper
D375,483 S 11/1996 Tashiro
5,580,159 A 12/1996 Liu
5,586,905 A 12/1996 Marshall et al.
5,605,395 A 2/1997 Peng
5,607,328 A 3/1997 Joly
5,624,283 A 4/1997 Hotea
5,626,419 A 5/1997 Lin
5,639,157 A 6/1997 Yeh
5,652,032 A 7/1997 Kac
5,653,616 A 8/1997 Hotea
5,695,279 A 12/1997 Sonnleitner
5,702,262 A 12/1997 Brown et al.
5,702,268 A 12/1997 Lien et al.
5,707,136 A 1/1998 Byers
5,709,457 A 1/1998 Hara
5,712,002 A 1/1998 Reilly, III
5,720,544 A 2/1998 Shu
5,722,766 A 3/1998 Shu
5,727,872 A 3/1998 Liou
5,759,062 A 6/1998 Chen
5,775,933 A 7/1998 Chen
5,776,559 A 7/1998 Woolford
5,776,599 A 7/1998 Haluska et al.
5,785,412 A 7/1998 Wu et al.
5,788,361 A 8/1998 Lee
5,791,765 A 8/1998 Lin
5,791,940 A 8/1998 Chen et al.
5,807,134 A 9/1998 Hara
5,816,849 A 10/1998 Schmidt
5,816,862 A 10/1998 Tseng
5,820,248 A 10/1998 Ferguson
5,822,855 A 10/1998 Szczesny et al.
5,828,183 A 10/1998 Wang
5,829,865 A 11/1998 Ahroni
5,834,901 A 11/1998 Shen
5,839,819 A 11/1998 Pan
5,848,838 A 12/1998 Presta
5,852,348 A 12/1998 Lin
5,854,451 A 12/1998 Chou
5,855,705 A 1/1999 Gauthier
5,860,731 A 1/1999 Martinez
5,860,830 A 1/1999 Wu
5,869,151 A 2/1999 Chong
5,878,989 A 3/1999 Allman
5,893,634 A 4/1999 Wang
5,908,238 A 6/1999 Huang
5,921,806 A 7/1999 Shuey
5,934,793 A 8/1999 Rahman
5,937,496 A 8/1999 Benoit et al.
5,938,168 A 8/1999 Adams
5,957,723 A 9/1999 Gort-Barten
5,966,393 A 10/1999 Hide et al.
5,971,810 A 10/1999 Taylor
5,979,859 A 11/1999 Vartanov et al.
6,004,006 A 12/1999 Wang
6,007,362 A 12/1999 Davis et al.
6,030,670 A 2/2000 Chang
6,053,774 A 4/2000 Lin
6,056,427 A 5/2000 Kao
6,079,848 A 6/2000 Ahroni
6,084,357 A 7/2000 Janning
6,086,395 A 7/2000 Lloyd et al.
6,095,874 A 8/2000 Quaranta
6,099,920 A 8/2000 Kao
6,111,201 A 8/2000 Drane et al.
6,113,430 A 9/2000 Wu
6,116,563 A 9/2000 Tsai
6,120,312 A 9/2000 Shu
6,123,433 A 9/2000 Chen
6,139,376 A 10/2000 Ooya et al.
6,147,367 A 11/2000 Yang et al.
6,149,448 A 11/2000 Haller et al.
6,155,697 A 12/2000 Ahroni
6,162,515 A 12/2000 Hill
6,203,169 B1 3/2001 Coushaine et al.
6,217,191 B1 4/2001 Wu et al.
6,228,442 B1 5/2001 Coco
6,241,559 B1 6/2001 Taylor
6,245,425 B1 6/2001 McCullough et al.
6,257,736 B1 7/2001 Fehrenbach
6,257,740 B1 7/2001 Gibboney, Jr.
6,257,793 B1 7/2001 Lin
6,261,119 B1 7/2001 Green
6,273,574 B1 8/2001 Wang et al.
6,283,797 B1 9/2001 Wu
6,320,327 B1 11/2001 Lavatelli et al.
6,328,593 B1 12/2001 Chang et al.
6,347,965 B1 2/2002 Pan
D454,110 S 3/2002 Andre et al.
6,354,719 B1 3/2002 Pan
6,361,368 B1 3/2002 Tseng
6,363,607 B1 4/2002 Chen et al.
6,407,411 B1 6/2002 Wojnarowski et al.
6,452,317 B1 9/2002 Tseng
6,457,839 B1 10/2002 Grandoit
6,458,435 B1 10/2002 Lai
6,514,581 B1 2/2003 Gregory
6,533,437 B1 3/2003 Ahroni
6,541,800 B2 4/2003 Barnett et al.
6,544,070 B1 4/2003 Radliff
6,571,340 B1 5/2003 Lee
6,576,844 B1 6/2003 Kamata
6,580,182 B2 6/2003 Janning
6,588,914 B1 7/2003 Tang
6,592,094 B1 * 7/2003 Kao ..... 248/529
6,595,657 B1 7/2003 Shieh
D478,310 S 8/2003 Andre et al.
6,609,814 B2 8/2003 Ahroni
6,623,291 B1 9/2003 Tsai
6,634,766 B1 10/2003 Gordon
6,644,836 B1 11/2003 Adams
D483,721 S 12/2003 Kim et al.
6,666,734 B2 12/2003 Fukatsu
6,672,750 B1 1/2004 Kao
D486,385 S 2/2004 Smith-Kielland et al.
6,733,167 B1 5/2004 Kao
6,752,512 B2 6/2004 Pan
6,774,549 B2 8/2004 Tsai et al.
6,794,825 B1 9/2004 Kao
6,805,463 B2 10/2004 Shieh
6,824,293 B2 11/2004 Chang
6,830,358 B2 12/2004 Allen
6,840,655 B2 1/2005 Shen
6,840,802 B2 1/2005 Shepherd
6,854,916 B2 2/2005 Hsieh
6,866,394 B1 3/2005 Hutchins et al.
6,869,316 B2 3/2005 Hinkle et al.
6,883,951 B2 4/2005 Wu
6,884,083 B2 4/2005 Shepherd
6,908,215 B2 6/2005 Wu
6,929,383 B1 8/2005 Janning
D509,797 S 9/2005 Milan
6,942,355 B1 9/2005 Castiglia
6,951,405 B2 10/2005 Yao
6,962,498 B2 11/2005 Kohen
7,021,598 B2 4/2006 Kao
7,029,145 B2 4/2006 Frederick
7,045,965 B2 5/2006 Li et al.
7,052,156 B2 5/2006 Primeau
7,055,980 B2 6/2006 Wu
7,055,981 B2 6/2006 Yao
7,066,628 B2 6/2006 Allen
7,066,739 B2 6/2006 McLeish
7,108,514 B2 9/2006 Chen et al.
D530,277 S 10/2006 Lin
7,128,954 B2 10/2006 Tsai
7,132,139 B2 11/2006 Yang
7,144,610 B1 12/2006 Estes et al.
7,145,105 B2 12/2006 Gaulard
7,147,518 B2 12/2006 Marechal et al.
7,192,303 B2 3/2007 Kohen

(56) References Cited

U.S. PATENT DOCUMENTS 7,204,720 B1 4/2007 Shiu
7,207,844 B2 4/2007 Peng
7,235,815 B2 6/2007 Wang
7,253,556 B1 8/2007 Gibboney
7,253,714 B1 8/2007 Tsui
7,264,392 B2 9/2007 Massabki et al.
7,270,450 B2 9/2007 Chan
7,311,566 B2 12/2007 Dent
7,315,692 B2 1/2008 Chow
7,318,744 B2 1/2008 Kuo
7,326,091 B2 2/2008 Nania et al.
7,393,019 B2 7/2008 Taga et al.
7,422,489 B1 9/2008 Tseng
D580,355 S 11/2008 Hussaini et al.
7,445,824 B2 11/2008 Leung et al.
7,453,194 B1 11/2008 Gibboney
D582,846 S 12/2008 Lett
7,462,066 B2 12/2008 Kohen
D585,384 S 1/2009 Andre et al.
7,473,024 B2 1/2009 Gibboney
7,527,508 B1 5/2009 Lee et al.
7,554,266 B1 6/2009 Chen
D598,374 S 8/2009 Sasada
7,575,362 B1 8/2009 Hsu
7,581,870 B2 9/2009 Massabki et al.
7,585,187 B2 9/2009 Daily et al.
7,585,552 B2 9/2009 Meseke
7,609,006 B2 10/2009 Gibboney
D608,685 S * 1/2010 Krize ..... D11/130
7,652,210 B2 1/2010 White
D609,602 S * 2/2010 Krize ..... D11/130
D611,409 S 3/2010 Green et al.
7,695,298 B2 4/2010 Arndt et al.
7,893,627 B2 2/2011 Li
D638,355 S 5/2011 Chen
8,007,129 B2 8/2011 Yang
8,053,042 B1 11/2011 Loomis
8,062,718 B2 11/2011 Schooley
8,100,546 B2 1/2012 Lutz et al.
8,132,360 B2 3/2012 Jin et al.
8,132,649 B2 3/2012 Rogers
8,298,633 B1 10/2012 Chen
8,348,466 B2 1/2013 Plumb et al.
8,450,950 B2 5/2013 McRae
8,454,186 B2 6/2013 Chen
8,454,187 B2 6/2013 Chen
8,469,734 B2 6/2013 Chen
8,469,750 B2 6/2013 Chen
D686,523 S 7/2013 Chen
8,534,186 B2 9/2013 Glucksman et al.
8,562,175 B2 10/2013 Chen
8,568,015 B2 10/2013 Chen
8,569,960 B2 10/2013 Chen
8,573,548 B2 11/2013 Kuhn et al.
8,592,845 B2 11/2013 Chen
D696,153 S 12/2013 Chen
8,608,342 B2 12/2013 Chen
8,853,721 B2 10/2014 Chen
8,863,416 B2 10/2014 Leung et al.
8,870,404 B1 10/2014 Chen
8,876,321 B2 11/2014 Chen
8,916,242 B2 12/2014 Fu et al.
8,936,379 B1 1/2015 Chen
8,959,810 B1 2/2015 Leung et al.
2002/0002015 A1 1/2002 Mochizuki et al.
2002/0097573 A1 7/2002 Shen
2002/0109989 A1 8/2002 Chuang
2002/0114663 A1 8/2002 Chung
2002/0118540 A1 8/2002 Ingrassia
2002/0149936 A1 10/2002 Mueller et al.
2003/0096542 A1 5/2003 Kojima
2003/0142494 A1 7/2003 Ahroni
2003/0198044 A1 10/2003 Lee
2003/0198048 A1 10/2003 Frederick
2003/0206412 A1 11/2003 Gordon
2003/0218412 A1 11/2003 Shieh
2004/0004435 A1 1/2004 Hsu
2004/0012950 A1 1/2004 Pan
2004/0090770 A1 5/2004 Primeau
2004/0096596 A1 5/2004 Palmer, III et al.
2004/0105270 A1 6/2004 Shieh
2004/0115984 A1 6/2004 Rudy et al.
2004/0145916 A1 7/2004 Wu
2004/0161552 A1 8/2004 Butts, Jr.
2004/0182597 A1 9/2004 Smith et al.
2005/0048226 A1 3/2005 Gary et al.
2005/0077525 A1 4/2005 Lynch et al.
2005/0122723 A1 6/2005 Frederick
2005/0249891 A1 11/2005 Kitamura et al.
2005/0249892 A1 11/2005 Rocheleau
2005/0286267 A1 12/2005 Wang
2006/0000634 A1 1/2006 Arakawa
2006/0048397 A1 3/2006 King et al.
2006/0146578 A1 7/2006 Kao
2006/0164834 A1 7/2006 Kao
2006/0270250 A1 11/2006 Allen
2006/0274556 A1 12/2006 Massabki et al.
2007/0091606 A1 4/2007 Reed
2007/0092664 A1 4/2007 Chun
2007/0177402 A1 8/2007 Wu
2007/0230174 A1 10/2007 Hicks et al.
2007/0253191 A1 11/2007 Chin et al.
2008/0007951 A1 1/2008 Chan
2008/0025024 A1 1/2008 Yu
2008/0107840 A1 5/2008 Leung et al.
2008/0149791 A1 6/2008 Bradley
2008/0186731 A1 8/2008 Graham
2008/0186740 A1 8/2008 Huang et al.
2008/0205020 A1 8/2008 Vich
2008/0296604 A1 12/2008 Chou et al.
2008/0303446 A1 12/2008 Ding
2008/0307646 A1 12/2008 Zaderej et al.
2009/0002991 A1 1/2009 Huang
2009/0023315 A1 1/2009 Pfeiffer
2009/0059578 A1 3/2009 Lau
2009/0213620 A1 8/2009 Lee
2009/0260852 A1 10/2009 Schaffer
2009/0289560 A1 11/2009 Oliva
2009/0308637 A1 12/2009 Amils
2010/0000065 A1 1/2010 Cheng et al.
2010/0053991 A1 3/2010 Boggs
2010/0067242 A1 3/2010 Fung
2010/0072747 A1* 3/2010 Krize ..... 285/330
2010/0099287 A1 4/2010 Colburn et al.
2010/0136808 A1 6/2010 Vanzo
2010/0159713 A1 6/2010 Nishihira et al.
2010/0195332 A1 8/2010 Wasem
2010/0196628 A1 8/2010 Shooley
2010/0263911 A1 10/2010 Watanabe
2011/0062875 A1 3/2011 Altamura
2011/0076425 A1 3/2011 Cheng et al.
2011/0256750 A1 10/2011 Chen
2012/0009360 A1 1/2012 Fu et al.
2013/0059094 A1 3/2013 Chen
2013/0108808 A1* 5/2013 Leung et al. ..... 428/18
2013/0120971 A1 5/2013 Chen
2013/0301246 A1 11/2013 Chen
2013/0301247 A1 11/2013 Chen
2013/0308301 A1 11/2013 Chen
2013/0309908 A1 11/2013 Sandoval et al.
2014/0036483 A1 2/2014 Chen
2014/0049168 A1 2/2014 Chen
2014/0049948 A1 2/2014 Chen
2014/0087094 A1 3/2014 Leung et al.
2014/0215864 A1 8/2014 Fischer, Jr. et al.
2014/0268689 A1 9/2014 Chen
2014/0287618 A1 9/2014 Chen
2014/0334134 A1 11/2014 Loomis
2015/0029703 A1 1/2015 Chen
2015/0070878 A1 3/2015 Yu
2015/0157159 A1 6/2015 Leung et al.
2015/0272250 A1 10/2015 Chen
2016/0021957 A1 1/2016 Chen

(56) References Cited

U.S. PATENT DOCUMENTS

FOREIGN PATENT DOCUMENTS

| | | | |
|---|---|---|---|
| CN | 2242654 | Y | 12/1996 |
| CN | 1181693 | | 5/1998 |
| CN | 2332290 | Y | 8/1999 |
| CN | 2484010 | Y | 4/2002 |
| CN | 1509670 | A | 7/2004 |
| CN | 2631782 | Y | 8/2004 |
| CN | 2751226 | Y | 1/2006 |
| CN | 100409504 | C | 9/2007 |
| CN | 100409506 | C | 8/2008 |
| CN | 201187701 | Y | 1/2009 |
| CN | 201829727 | U | 5/2011 |
| CN | 102224645 | A | 10/2011 |
| DE | 8436328 | | 4/1985 |
| DE | 10235081 | A1 | 2/2004 |
| EP | 434425 | A1 | 6/1991 |
| EP | 0552741 | | 7/1993 |
| EP | 0342050 | B1 | 8/1995 |
| EP | 0727842 | | 8/1996 |
| EP | 895742 | B1 | 2/1999 |
| EP | 0920826 | A1 | 6/1999 |
| EP | 1 049 206 | A2 | 11/2000 |
| EP | 1763115 | A2 | 3/2007 |
| EP | 2533374 | A1 | 12/2012 |
| FR | 1215214 | | 4/1960 |
| GB | 1150390 | | 4/1969 |
| GB | 1245214 | | 9/1971 |
| GB | 2112281 | A | 7/1983 |
| GB | 2137086 | A | 10/1984 |
| GB | 2 169 198 | A | 7/1986 |
| GB | 2172135 | A | 9/1986 |
| GB | 2178910 | A | 2/1987 |
| GB | 2208336 | A | 3/1989 |
| GB | 2221104 | A | 1/1990 |
| GB | 2396686 | A | 6/2004 |
| JP | 11121123 | A | 4/1999 |
| WO | WO 91/10093 | | 7/1991 |
| WO | WO 96/24966 | | 8/1996 |
| WO | WO 96/26661 | A1 | 9/1996 |
| WO | WO 2004/008581 | A1 | 1/2004 |
| WO | WO 2007140648 | A1 | 12/2007 |
| WO | WO 2009/115860 | A1 | 9/2009 |

OTHER PUBLICATIONS

U.S. Appl. No. 90/012,209, filed Mar. 24, 2012, inventor Johnny Chen.

Petition for Inter Partes Review of U.S. Pat. No. 8,454,186, Case No. IPR2014-01263, filed Aug. 8, 2014.

Petition for Inter Partes Review of U.S. Appl. No. 8,454,187, Case No. IPR2014-01264, filed Aug. 8, 2014.

U.S. Appl. No. 90/020,074, filed Jul. 14, 2014, U.S. Pat. No. 8,454,187.

U.S. Appl. No. 90/020,073, filed Jul. 7, 2014, U.S. Pat. No. 8,454,186.

U.S. Appl. No. 14/725,972, filed May 29, 2015, Inventor Johnny Chen.

U.S. Appl. No. 14/730,649, filed Jun. 4, 2015, Inventor Johnny Chen.

Petition for Inter Partes Review, Case IPR2016-00802, U.S. Pat. No. 9,044,056, dated Apr. 28, 2016 (73 pgs.).

Petition for Inter Partes Review, Case IPR2016-00801, U.S. Pat. No. 8,454,187, dated Apr. 18, 2016 (69 pgs.).

Petition for Inter Partes Review, Case IPR2016-00800, U.S. Pat. No. 8,454,186, dated Apr. 18, 2016 (78 pgs.).

U.S. Pat. No. 14/739,693, filed Jun. 15, 2015, Inventor Johnny Chen.

U.S. Pat. No. 14/851,148, filed Sep. 11, 2015, Inventor Johnny Chen.

U.S. Pat. No. 14/970,118, filed Dec. 15, 2015, Inventor Johnny Chen.

* cited by examiner

Axis A1
204
202
204
202
200
A1
138
140
142
104
136
203
106
202
200
204
101
2B
138
A1
204
206
116
208
118
112
102
114
A1

A
102
202
208
204

A1
104
136
101
203
202
204
3B
116
208
112
102
114
A

A
102
204
208
202

A
104
136
101
200
4B
116
208
112
102
114
A 302
304
302
304
300
A1
140
104
136
300
5B
302
138
A1
304
A2
306
116
308
118
112
102
114
A2

102
308

A
140
136
104
300
116
6B
308
112
102
114
A 102
302
304
304

A
140
136
104
300
116
7B
308
112
102
114
A 400
404
402
A
140
136
104
400
8B
138
A
404
406
402
116
408
118
112
102
114
A 102
408

A
140
136
104
400
116
9B
408
112
102
114
A 102
400
408
404
402

A
140
136
104
400
116
10B
408
112
102
114
A

MODULAR TREE WITH LOCKING TRUNK

RELATED APPLICATIONS

The present application claims the benefit of U.S. Provisional Application No. 61/680,927 filed Aug. 8, 2012, and the benefit of U.S. Provisional Application No. 61/643,968 filed May 8, 2012, both of which are incorporated herein in their entireties by reference.

TECHNICAL FIELD

The present invention is generally directed to artificial trees. More specifically, the present invention is directed to artificial trees having separable, modular tree portions mechanically connectable between trunk portions.

BACKGROUND

Artificial, decorative trees, such as Christmas trees, generally require some assembly by a user. One common type of artificial tree includes a base and one to four tree sections that are joined together at the trunk. An end of the trunk portion of the first tree section is firstly inserted into the tree base. The user then inserts an end of the trunk portion of the second tree section into the other end of the trunk portion of the first tree section, and so on, until all tree sections are stacked atop one another and the tree is completely assembled.

When joining the ends of the trunk sections together, some tree designs require that the ends be fit together in a particular rotational orientation, while other designs do not. Requiring a particular rotational orientation or rotational alignment may result in the tree sections fitting together in only one orientation, thereby often increasing the difficulty of assembly for the user.

Other designs may feature tree sections for universal insertion into other receiving trunk sections without particular orientation requirements. Such trees can be easier to assemble, but the tree sections may easily be rotated relative to one another after assembly.

Avoiding rotation or twisting of the tree sections can be desirable from an aesthetic standpoint. For example, after a tree is decorated with ornaments and light strings, and perhaps with one side facing a wall, a user would prefer that the tree sections not be rotated about one another so as to preserve the appearance of the decorated, perhaps lit, tree.

In addition to maintaining aesthetic appearances, for pre-lit artificial trees having light strings already attached to the tree sections, and especially for those having wiring extending between trunk sections, it can be particularly useful to avoid rotation of the tree sections about one another. For some designs, if a tree section rotates or twists relative to another, internal wiring can be damaged. It is likewise desirable for non-pre-lit tree designs, once decorated with light strings, to avoid rotation of the tree sections about one another for similar reasons.

SUMMARY

Embodiments of the present application substantially meet the aforementioned needs of the industry. According to an embodiment of the present invention, an artificial tree comprises two or more modular tree portions mechanically connectable between trunk portions such that the tree trunk is locked to prohibit twisting or other rotational movement relative to the modular tree portions. Embodiments of the invention provide myriad shapes and alignment configurations for both the projecting trunk end and the receiving trunk end.

In a feature and advantage of embodiments of the invention, the locking trunk portions are operably coupleable to each other in a plurality of different rotational orientations, thereby providing simplified installation for the user. In contrast to the trunk portions of the prior art, embodiments of the present invention allow for the secure coupling between trunk portions in a plurality of positions. In an embodiment, channels are spaced at two or more locations along an end insertable portion to create a ring of individual projections such that each channel can couple with one or more protuberances on the opposite receiving trunk portion. In another embodiment, a sawtooth configuration likewise contains similar arrays of projections and voids along the projecting end insertable portion to couple with one or more protuberances on the opposite receiving trunk portion. Embodiments therefore allow for the assembly of the tree in not one particular rotational orientation, but myriad orientations. When assembling the (sometimes heavy) trunk sections, this feature allows the user to easily couple the tree portions without struggling to find the particular rotational locking orientation of both the projecting trunk end and the receiving trunk end, as is often found in the prior art.

In another feature and advantage of embodiments of the invention, the locking trunk portions provide a secure, non-twistable trunk for the tree. By not allowing rotation or twisting of the tree sections, aesthetics of the tree are improved. For example, after a tree is decorated with ornaments and light strings, and perhaps with one side facing a wall, a user might prefer that the tree sections not be rotated about one another so as to preserve the appearance of the decorated, perhaps lit, tree.

Further, the secure, non-twistable trunk of embodiments of the invention improves the safety of artificial trees. By locking the trunk in a fixed position, embodiments of the present invention prevent the rotation or twisting of internal wiring on pre-lit trees, thereby preserving the integrity of internal wiring. Similarly, once non-pre-lit trees are decorated with light strings, embodiments of the present invention prevent the rotation or twisting of the wiring of those light strings, similarly preserving the integrity of those light strings.

In an embodiment, the claimed invention includes a tree trunk system for an artificial decorative tree comprising a first trunk body including a distal end and a proximal end, and defining a first central axis extending from the distal end to the proximal end, the distal end having an insertable portion defining a plurality of axially-extending channels spaced circumferentially about the insertable end, each of the channels extending radially inward. The trunk system also includes a second trunk body including a distal end and a hollow proximal end, and defining a second central axis extending from the distal end to the proximal end, the proximal end configured to receive the insertable portion of the first trunk body and having a protuberance extending radially inward. The protuberance of the second trunk body aligns with, and fits into one of the plurality of channels of the first trunk body when the first trunk body and the second trunk body are aligned on a common central axis, and the end portion of the first trunk body is inserted into the proximal end of the second trunk body, thereby preventing rotation of the first trunk body relative the second trunk body, about the common central axis.

In another embodiment, the claimed invention comprises a lighted artificial tree that includes a first tree portion and a second tree portion. The first tree portion includes: a first trunk body having a distal end and a proximal end, and defining a first central axis extending from the distal end to the proximal end, the distal end having an insertable portion defining one or more channels; a first electrical connector positioned in the distal end of the first trunk body; a first wiring harness electrically connected to the first electrical connector and having wires extending axially within the trunk body and away from the first electrical connector; and a first light string electrically connected to the wires of the first wiring harness. The second tree portion includes: a second trunk body including a distal end and a hollow proximal end, the proximal end configured to receive the insertable portion of the first trunk body along a common central axis and having a protuberance, the protuberance configured to be received by the one or more channels of the first trunk body; a second electrical connector configured to electrically connect with the second electrical connector independently of a relative rotational alignment of the first electrical connector and the second electrical connector about the common central axis, the second electrical connector positioned in the proximal end of the second trunk body and; a second wiring harness electrically connected to the second electrical connector and having wires extending axially within the second trunk body and away from the first electrical connector. The first trunk body when coupled to the second trunk body cannot rotate relative to the second trunk body about the common central axis, and the first electrical connector is electrically connected to the second electrical connector.

In yet another embodiment, the claimed invention comprises a lighted artificial tree that also includes a first tree portion and a second tree portion. The first tree portion includes: a first trunk body having a distal end and a proximal end, and defining a first central axis extending from the distal end to the proximal end, the distal end having an insertable portion defining a plurality of channels; a first electrical connector positioned in the distal end of the first trunk body; a first wiring harness electrically connected to the first electrical connector and having wires extending axially within the trunk body and away from the first electrical connector; and a first light string electrically connected to the wires of the first wiring harness. The second tree portion includes: a second trunk body including a distal end and a hollow proximal end, the proximal end configured to receive the insertable portion of the first trunk body along a common central axis and having a protuberance, the protuberance configured to be received by one of the plurality of channels of the first trunk body, such that the first trunk body is connectable to the second trunk body in any one of a plurality of rotational coupling alignment positions; a second electrical connector configured to electrically connect with the second electrical connector in one of a plurality of rotational coupling alignment positions of the first electrical connector relative the second electrical connector about the common central axis, the second electrical connector positioned in the proximal end of the second trunk body and; a second wiring harness electrically connected to the second electrical connector and having wires extending axially within the second trunk body and away from the first electrical connector. The first tree portion is coupled to the second tree portion, the first trunk body cannot rotate relative to the second trunk body about the common central axis, and the first electrical connector cannot rotate relative to the second electrical connector and the first electrical connector is electrically connected to the second electrical connector.

The above summary of the invention is not intended to describe each illustrated embodiment or every implementation of the present invention. The figures and the detailed description that follow more particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1:
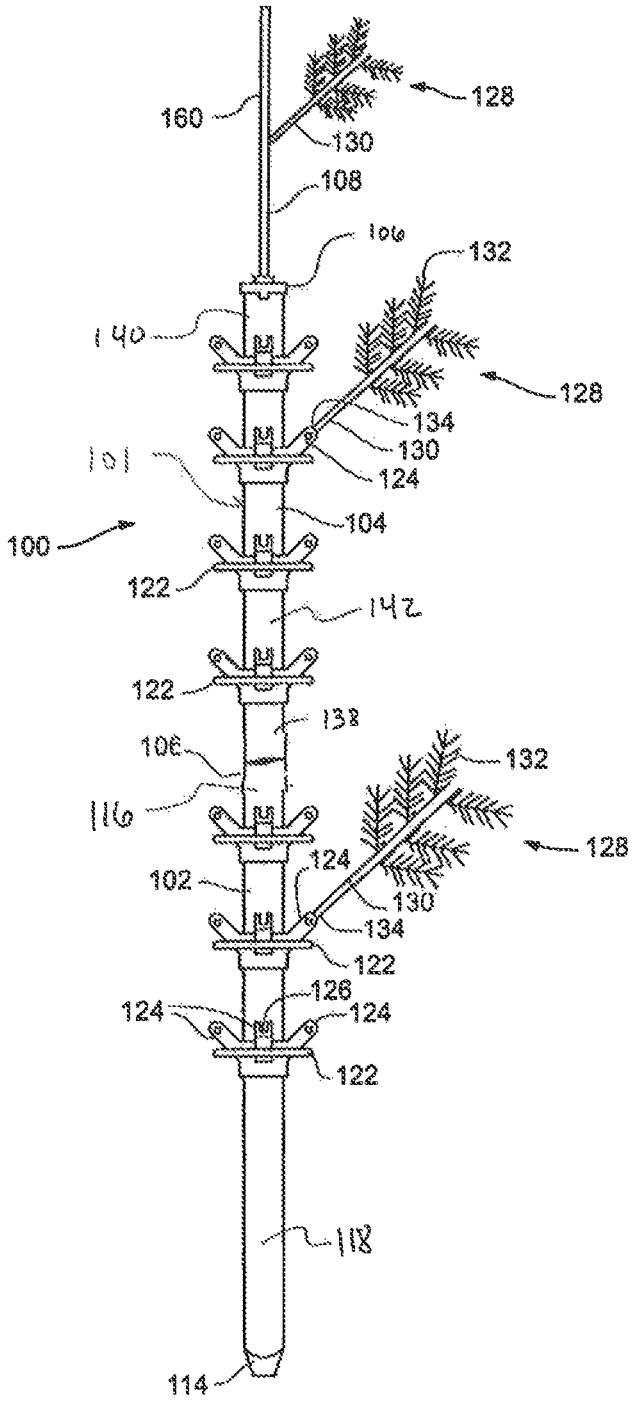
FIG. 1 is a front view of a modular, artificial tree trunk assembly, according to an embodiment.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE DRAWINGS

Referring to FIG. 1, an embodiment of an artificial tree trunk 100 of the present invention is depicted. Artificial tree trunk 100 includes trunk 101 having first trunk portion 102, second trunk portion 104, and trunk coupling mechanism 106. In some embodiments, trunk 101 may include more trunk portions, such as third trunk portion 108, and subsequently, a second trunk coupling mechanism 106 to couple second trunk portion 104 and third trunk portion 108. When tree trunk 101 is assembled, as depicted, trunk portions 102, 104, and 108 are aligned along a common vertical or central axis and held in a general vertical orientation. To maintain the general vertical orientation, first trunk portion 102 is insertable into a base or stand portion (not depicted) that supports the entire assembly. Such a base includes a receiver, such as a channel or other opening, as understood by those skilled in the art, for receiving a bottom portion of trunk portion 102, the receiver having an inside diameter equal to or slightly larger than, an outside diameter of the bottom portion of trunk portion 102. In another embodiment, first trunk portion 102 and the can comprise a trunk coupling mechanism similar to trunk coupling mechanism 106, as will be described.

In an embodiment, first trunk portion 102 as depicted comprises a generally cylindrical, hollow structure including trunk body 112 having a lower (proximal) end 114, an upper (distal) end 116, outside wall 118, and one or more optional branch-support rings 122.

Each branch 128 generally includes primary branch extension 130 and may also include multiple secondary branch extensions 132 extending away from branch extension 130. Branch 128 is connected to trunk portion 102 at a branch receiver 124 at trunk-end 134. Primary branch extension 130 of branches 128 may be bent or otherwise formed to define a loop or circular opening such that primary branch extension 130 of branch 128 may be secured to branch receiver 124 by way of a pin (not depicted) extending through branch receiver 124 and the loop formed at trunk-end 134 of branch 128. In this way, a branch 128 may be allowed to pivot about the pin and branch receiver 124, allowing first trunk portion 102 to collapse to a smaller envelope size for convenient storage.

Second trunk portion 104 as depicted also comprises a generally cylindrical, hollow structure including trunk body 136 having a lower (distal) end 138, an upper (proximal) end 140, outside wall 142, and in some embodiments, one or more branch-support rings 122. A length of insertable portion of trunk body 136 may vary depending on overall tree height. A taller tree will generally require a longer insertable portion. In some embodiments, the length of insertable portion ranges from 10% to 35% of the length of its corresponding trunk portion 104.

Third trunk portion 108 may further comprise branch-support rings (not depicted) adaptable to couple to the body 160 of third trunk portion 108, where multiple branch receivers extend outwardly and away from third trunk portion 108, just as branch-support rings 122 along first trunk portion 102 and second trunk portion 104. In some embodiments, branch receivers define a vein for receiving a primary branch extension 130 of a branch 128. In an alternative embodiment, branches 128 are directly coupled to the body 160 of third trunk portion 108.

Figures 2A, 2B, 3A, 3B, 4A, 4B:
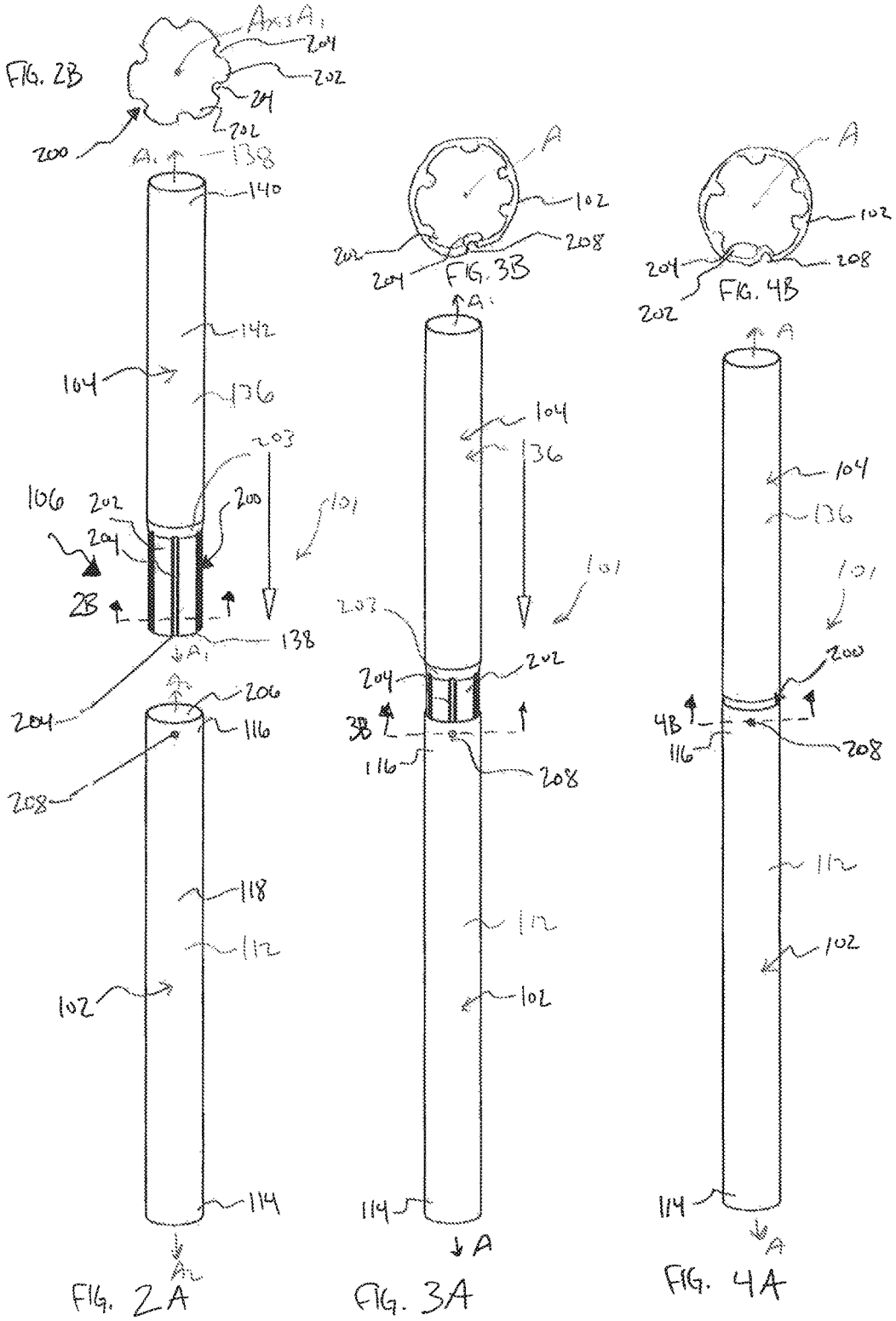
FIG. 2A is a perspective view of two modular artificial tree trunk sections shown in separation, according to an embodiment.
FIG. 2B is a cross-sectional view of the two tree trunk sections of FIG. 2A along the axis indicated in FIG. 2A, according to an embodiment.
FIG. 3A is a perspective view of the two modular artificial tree trunk sections of FIG. 2A shown in partial engagement, according to an embodiment.
FIG. 3B is a cross-sectional view of the two tree trunk sections of FIG. 2A along the axis indicated in FIG. 3A, according to an embodiment.
FIG. 4A is a perspective view of the two modular artificial tree trunk sections of FIG. 2A shown in complete engagement, according to an embodiment.
FIG. 4B is a cross-sectional view of the two tree trunk sections of FIG. 2A along the axis indicated in FIG. 4A, according to an embodiment.

Referring to FIG. 2A, exemplary trunk portions, for example, first trunk portion 102 with trunk body 112 and defining central axis A1, and second trunk portion 104 with trunk body 136 and defining central axis A2, as by coupling system or mechanism 106 are depicted in additional detail, and comprise a tree trunk coupling system 101. The depiction of the coupling of trunk portions and trunk bodies by coupling mechanism 106 is also illustrative of for example, second trunk portion 104 with third trunk portion 108, or third trunk portion 108 with a fourth trunk portion (not shown), and so on, in particular embodiments.

In an embodiment, coupling mechanism 106 comprises portions of both first trunk portion 102 and second trunk portion 104. Beginning with second trunk portion 104, second trunk portion 104 comprises insertable portion 200. Insertable portion 200 can be defined by a relative circumference that is equal to, or smaller than the circumference of the rest of second trunk portion 104; for example, the circumference of outside wall 142.

Referring to FIGS. 2A to 4B, insertable portion 200, in an embodiment, comprises a plurality of edges and apertures or channels to create a unique shape configured to interlock with a receiving end 206 of first trunk portion 102. Think portion 102 and 104 are aligned and coupled along a common vertical axis A.

In an embodiment, referring to FIG. 2A and cross-sectional view FIG. 2B, insertable portion 200 comprises one or more projections 202 and channels or indentations 204, forming a corrugated structure. Channels 204 are spaced radially about insertable portion 200, and extend radially inward. Projections 202 and channels 204 extend axially along a direction from first or lower end 138 towards a second or upper end 140. In the depicted embodiment, projections 202 and channels 204 extend an entire length of insertable portion 200, extending from a distal end of end 138 to angled transition portion 203 of trunk portion 104. At distal end of end 138, trunk 104 has a diameter that is smaller than a diameter of end 140. At angled transition portion 203, a diameter of trunk 103 transitions from a smaller diameter, equal to, or similar to, a diameter of distal end 138, to a larger diameter, equal to, or similar to, a diameter of end 140. In other embodiments, projections 202 and channels 204 may not extend all the way to angled transition portion 203. In one such embodiment, projections 202 and channels 204 extend from distal end of end 138 up to halfway to portion 203. In another such embodiment, projections 202 and channels 204 may extend from distal end of end 138 up to a range of 25% to 100% of the distance to portion 203 (100% meaning projections 202 and channels 204 would be directly adjacent portion 203, as depicted in FIG. 2A). In another such embodiment, projections 202 and channels 204 are less long, and extend at least 5% of the distance to portion 203, but less than 25% of the distance to portion 203. Such ranges and embodiments are not meant to be exhaustive, and other such ranges are within the scope of the claimed invention as described herein. FIGS. 5A-10A depict embodiments having "shorter" projections 202 and channels 204.

As is depicted, particularly in FIG. 2B, channels 204 are defined by trunk wall 142, and do not generally comprise open slots. In other words, when viewed in cross section, as in FIG. 2B, a circumferential edge of distal end 138 is continuous, with no holes or openings through the material comprising trunk wall 142.

As compared to open slots in which material is removed between projections, the use of indentations or channels 204 in end 200 results in greater structural strength in end 200, making it less likely that projections 204 or end 200 will be bent.

In other embodiments, channels 204 may comprise open, or through, slots, such that projections 202 do not have portions of trunk wall 142 between projections 202.

Still referring to FIGS. 2A-2B, although depicted such that all projections 202 and channels 204 have the same length, in other embodiments, some projections 202 may be longer than other projections 202, and some channels 204 may be longer than other channels 204. Further, the number of projections and channels may be greater than or fewer than the number of projections and channels depicted. In an embodiment, the number of channels is one.

While insertable portion 200 is defined by a unique shape as described above, it is best described, in this embodiment, relative to a circle spanning the circumference of insertable portion 200. An individual projection 202 is formed by a section of the edge of the circumference of the circle of insertable portion 200. Channel 204 is immediately adjacent a first projection 202 and defined by a cut-out from the circumference of the relative circle of insertable portion 200. Immediately adjacent channel 204 is a second projection 202, and immediately adjacent the second projection 202 is a second channel 204, and so on. Insertable portion 200 therefore comprises a series of projections 202 and channels 204 around the entire circumference of the circle of insertable portion 200. For example, referring to FIG. 2B, insertable portion 200 comprises a "circle" of six projections 202 and six channels 204, which alternate along the circumference. In other embodiments, a greater or lesser number of projections 202 and channels 204 can form the shape of insertable portion 200.

Generally, the number of channels 204 determines the maximum amount of rotation that could be required to rotationally align trunk portions, such as trunk portion 102 with trunk portion 104. The greater the number of channels 204, the less circumferential distance between channels, and the less rotation required to align convex point 208 with a channel 204. For example, in the embodiment depicted in FIGS. 2A-4B, trunk portion 104 includes six channels disbursed about generally-circular end 138. As such, each channel is separated by 60 degrees of rotation, at most. In another example, if trunk portion has eight channels, each channel is separated by 45 degrees of rotation. The more channels, the less distance between channels, and the less rotation required to join trunk portions 102 and 104. When assembling tree 100, especially for larger, heavier trees, the less rotation required to align and couple trunk portions, the more convenient for a user.

Although depicted as being distributed symmetrically about lower end 200, in some embodiments, channels 204 may not be distributed symmetrically.

In an embodiment, a large, electrified tree 100 having at least three trunk portions, 102, 104, and 108, with at least six sets of branch rings with branches, and at least 350 lights has at least six channels so as to minimize rotational movement at assembly.

Referring again to FIG. 2A and to additional components of coupling mechanism 106, first portion 102 comprises a receiving end 206 and one or more protuberances 208.

In an embodiment, receiving end 206 comprises an end of first trunk portion 102 and in an embodiment is substantially formed by the inner walls of the body of first trunk portion 102. Receiving end 206 is adapted to receive insertable portion 200 of second trunk portion 104. As such, the outer dimensions of insertable portion 200 are shaped just smaller than the inner dimensions of first trunk portion 102, and specifically, receiving end 206. In an embodiment, the lengths of projections 202 are configured to make flush contact with a respective inner side of first trunk portion 102 at receiving end 206.

Protuberance 208 projects radially inward from a location on outside wall 118 toward an opposite (inner) side of outside wall 118. In an embodiment, protuberance 208 may resemble a bump, point, or protusion positioned relatively proximate upper end 116 as depicted in FIG. 2A, but can be positioned more distal upper end 116 in other embodiments. In an embodiment, as depicted in FIGS. 2A, 3A, and 4A, protuberance 208 comprises a convex point. In other embodiments, other shapes or projections are also considered, depending on the shape and cut-out depth and size of channels 204. Protuberance 208 is configured to engage or fill the space created between two projections 202 by one of channels 204 on second trunk portion 104. In embodiments, receiving end 206 can comprise a plurality of protuberances 208 positioned accordingly along the circumference of outside wall 118 in relative alignment with channels 204 of second trunk portion 104.

In operation, to assemble any two trunk portions together, as shown by FIGS. 2A, 3A, and 4A, reference to first trunk portion 102 and second trunk portion 104 will again be made, but the assembly applies similarly to the coupling of any two adjoining trunk portions. Initially, referring to FIG. 2A, second trunk portion 104 is positioned over first trunk portion 102, and specifically, receiving end 206. Referring to FIG. 3A, second trunk portion 104 can be slid or inserted into first trunk portion 102. More specifically, insertable portion 200 can be slid into receiving end 206. In an embodiment, once the furthermost edge of second trunk portion 104 via projection 202 contacts protuberance 208, the user can rotate second trunk portion 104 or first trunk portion 102 such that any one of channels 204 aligns with protuberance 208. Once so aligned, insertable portion 200 can be pushed past protuberance 208 along the axis formed by the trunk portions 102 and 104, as depicted by FIG. 3A, where insertable portion 200 is shown with roughly half of its length past protuberance 208. In another embodiment, the user can align one of channels 204 with protuberance 208 when first trunk portion 102 and second trunk portion 104 are separated, as in FIG. 2A. In such an embodiment, insertable portion 200 can be pushed past protuberance along the axis A formed by the trunk portions 102 and 104 without rotation.

When insertable portion 200 is received by receiving end 206, protuberance 208 is configured to engage, partially or full filling the aperture created between two projections 202 by one of channels 204 on second trunk portion 104. As a result, protuberance 208 contacts the length of a particular channel 204 as insertable portion 200 is inserted and slid into first trunk portion 102. Referring to FIGS. 3A and 3B, insertable portion 200 is roughly halfway inserted and in partial engagement with first trunk portion 102. First trunk portion 102, as described above, has a relative circumference slightly larger than that of the relative circumference of the sections of edges of projections 202 (and insertable portion 200) and thereby secures second trunk portion 104 along those edges by an interference fit. Further, as depicted, protuberance 208 contacts one of channels 204 and prevents rotational movement of second trunk portion 104 relative to first trunk portion 102 by interference fit with one of channels 204.

Referring to FIG. 4A, insertable portion 200 can be slid further into first trunk portion 102 along the axis formed by the trunk portions 102 and 104 until insertable portion 200 is in complete engagement with receiving end 206. As depicted by FIG. 4B, when in complete engagement, first trunk portion 102 secures the edges of projections 202, and likewise, protuberance 208 further secures insertable portion 200 by contact with one of channels 204. Relative to FIG. 3B, the cross-section of FIG. 4B is more proximate upper end 140 due to the further insertion of insertable portion 200 and complete engagement of insertable portion 200 with receiving end 206.

In the embodiment described and depicted in FIGS. 2A-4B, a diameter of convex point 208 is only slightly less than a diameter of channel 204, such that when convex point 208 is inserted into channel 204, any rotation between trunk portion 102 and trunk portion 104 will be minimal, hence the trunks are rotationally locked. In an alternate embodiment, channels 204 may have a diameter somewhat, and in some cases significantly, greater than that of convex point 208. In such an embodiment, a greater amount of rotation between trunk portions 102 and 104 would be possible. In one such embodiment, a diameter of convex point 208 ranges from 5% to 99% of the diameter of a corresponding channel 204. In one embodiment that allows for relatively easy alignment of convex point 208 with a channel 204, yet minimizes a rotational range between trunk portions 102 and 104, convex point 208 has a diameter ranging from 60 to 90% of the diameter of channel 204.

Additional embodiments of coupling mechanisms are also considered, referring to the embodiment depicted in FIGS. 5A-7B. The embodiment depicted in FIGS. 5A-7B is substantially similar to coupling mechanism 106, with differences described herein.

Figures 5A, 5B, 6A, 6B, 7A, 7B:
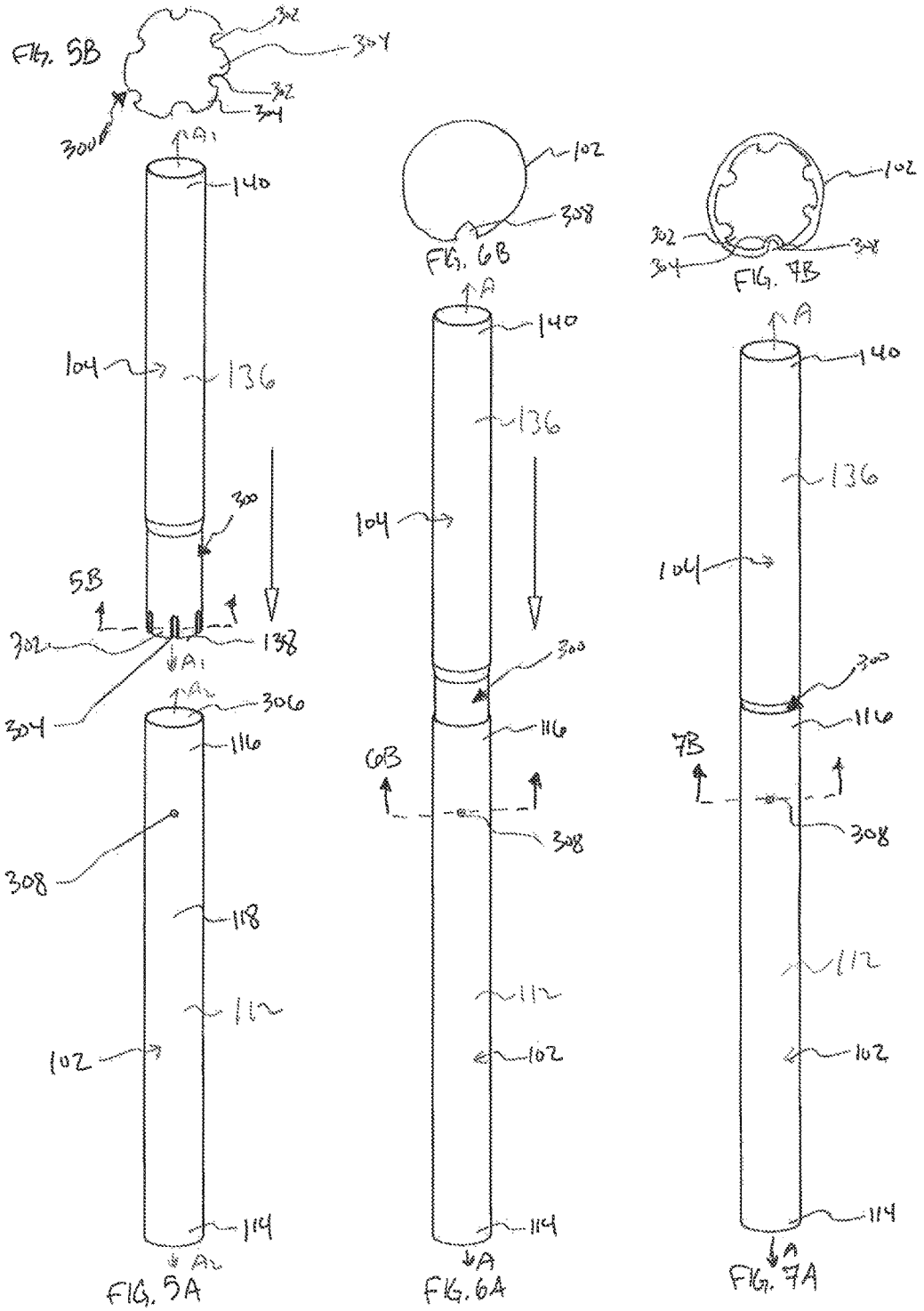
FIG. 5A is a perspective view of two modular artificial tree trunk sections shown in separation, according to an embodiment.
FIG. 5B is a cross-sectional view of the two tree trunk sections of FIG. 5A along the axis indicated in FIG. 5A, according to an embodiment.
FIG. 6A is a perspective view of the two modular artificial tree trunk sections of FIG. 5A shown in partial engagement, according to an embodiment.
FIG. 6B is a cross-sectional view of the two tree trunk sections of FIG. 5A along the axis indicated in FIG. 6A, according to an embodiment.
FIG. 7A is a perspective view of the two modular artificial tree trunk sections of FIG. 5A shown in complete engagement, according to an embodiment.
FIG. 7B is a cross-sectional view of the two tree trunk sections of FIG. 5A along the axis indicated in FIG. 7A, according to an embodiment.

In an embodiment, second trunk portion 104 comprises insertable portion 300. Insertable portion 300 is similar to insertable portion 200, and can therefore also be defined by a relative circumference that is smaller than the circumference of the rest of second trunk portion 104; for example, the circumference of outside wall 142. Insertable portion 300 comprises a plurality of edges and apertures or channels to create a unique shape configured to interlock with a receiving end 306 of first trunk portion 102. Referring to FIG. 5A and cross-sectional view FIG. 5B, insertable portion 300 comprises a plurality of projections 302 and channels 304, similar to those of projections 202 and 204. An individual projection 302 is formed by a section of the edge of the circumference of the circle of insertable portion 300. Channel 304 is immediately adjacent a first projection 302 and defined by a cut-out from the circumference of the relative circle of insertable portion 300. Immediately adjacent channel 304 is a second projection 302, and immediately adjacent the second projection 302 is a second channel 304, and so on. Insertable portion 300 therefore comprises a series of projections 302 and channels 304 around the entire circumference of the circle of insertable portion 300. As in the embodiments described above, insertable portion can comprise a greater or lesser number of projections 302 and channels 304. In contrast to projections 202 and channels 204 of insertable portion 200, which respectively ran the entire length of insertable portion 200, projections 302 and channels 304 span only a subsection of insertable portion 300, and not the entire length; for example, one-quarter of the length of insertable portion 300. Different lengths of projections 302 and channels 304 from that depicted in FIG. 5A are also considered.

In an embodiment, first portion 102 comprises a receiving end 306 and one or more protuberances 308. Receiving end 306 is substantially similar to receiving end 206, and thereby comprises an end of first trunk portion 102 and is substantially formed by the inner walls of the body of first trunk portion 102. Receiving end 306 is adapted to receive insertable portion 300 of second trunk portion 104. As such, the outer dimensions of insertable portion 300 are shaped just smaller than the inner dimensions of first trunk portion 102, and specifically, receiving end 306. Specifically, the lengths of projections 302 are configured to make flush contact with a respective inner side of first trunk portion 102 at receiving end 306.

Protuberance 308 is substantially similar to protuberance 208 and projects inwardly from a location on outside wall 118 toward an opposite (inner) side of outside wall 118. Protuberance 308 is positioned more distal upper end 116 than protuberance 208. In an embodiment, protuberance 308 comprises a convex point. In other embodiments, other shapes or projections are also considered, depending on the shape and cut-out depth and size of channels 304. Protuberance 308 is configured to engage or fill the aperture created between two projections 302 by one of channels 304 on second trunk portion 104. In embodiments, receiving end 306 can comprise a plurality of protuberances 308 positioned accordingly along the circumference of outside wall 118 in relative alignment with channels 304 of second trunk portion 104.

In operation, first trunk portion 102 and second trunk portion 104 are assembled via coupling of insertable portion 300 and receiving end 306 substantially similar to the assembly described above with respect to insertable portion 200 and receiving end 206. Referring to FIGS. 6A and 6B, when insertable portion 300 is roughly halfway inserted and in partial engagement with first trunk portion 102, the most distal edge (projections 302) have not yet contacted protuberance 308, as depicted in the cross-sectional view of FIG. 6B across outside wall 118 at protuberance 308.

In such an embodiment, once the furthermost edge of second trunk portion 104 via projection 302 contacts protuberance 308 the user can rotate second trunk portion 104 or first trunk portion 102 such that one of channels 304 aligns with protuberance 308 while the majority of insertable portion 300 is inserted into receiving end 306, compared to the embodiment depicted in FIGS. 2A-4B, where alignment occurred with the majority of insertable portion 200 not yet inserted into receiving end 206. In embodiments, alignment can be more easily accomplished with protuberance(s) located at first trunk portion 102 as depicted by protuberance 206, with protuberance(s) located at first trunk portion 102 as depicted by protuberance 306, depending on the weight and other configurations of first trunk portion 102 and second trunk portion 104. Once so aligned, insertable portion 300 can be pushed past protuberance 308 along the axis formed by the trunk portions 102 and 104, as depicted by FIGS. 7A and 7B.

Additional embodiments of coupling mechanisms are also considered, referring to the embodiment depicted in FIGS. 8A-10B. The embodiment depicted in FIGS. 8A-10B is substantially similar to coupling mechanism 106 and the embodiment of FIGS. 5A-7B with differences described herein.

In an embodiment, second trunk portion 104 comprises insertable portion 400. Insertable portion 400 is similar insertable portion 300 and insertable portion 200, and can therefore also be defined by a relative circumference that is smaller than the circumference of the rest of second trunk portion 104; for example, the circumference of outside wall 142. Insertable portion 400 comprises a plurality of teeth and apertures to create a unique shape configured to interlock with a receiving end 406 of first trunk portion 102.

Figures 8A, 8B, 9A, 9B, 10A, 10B:
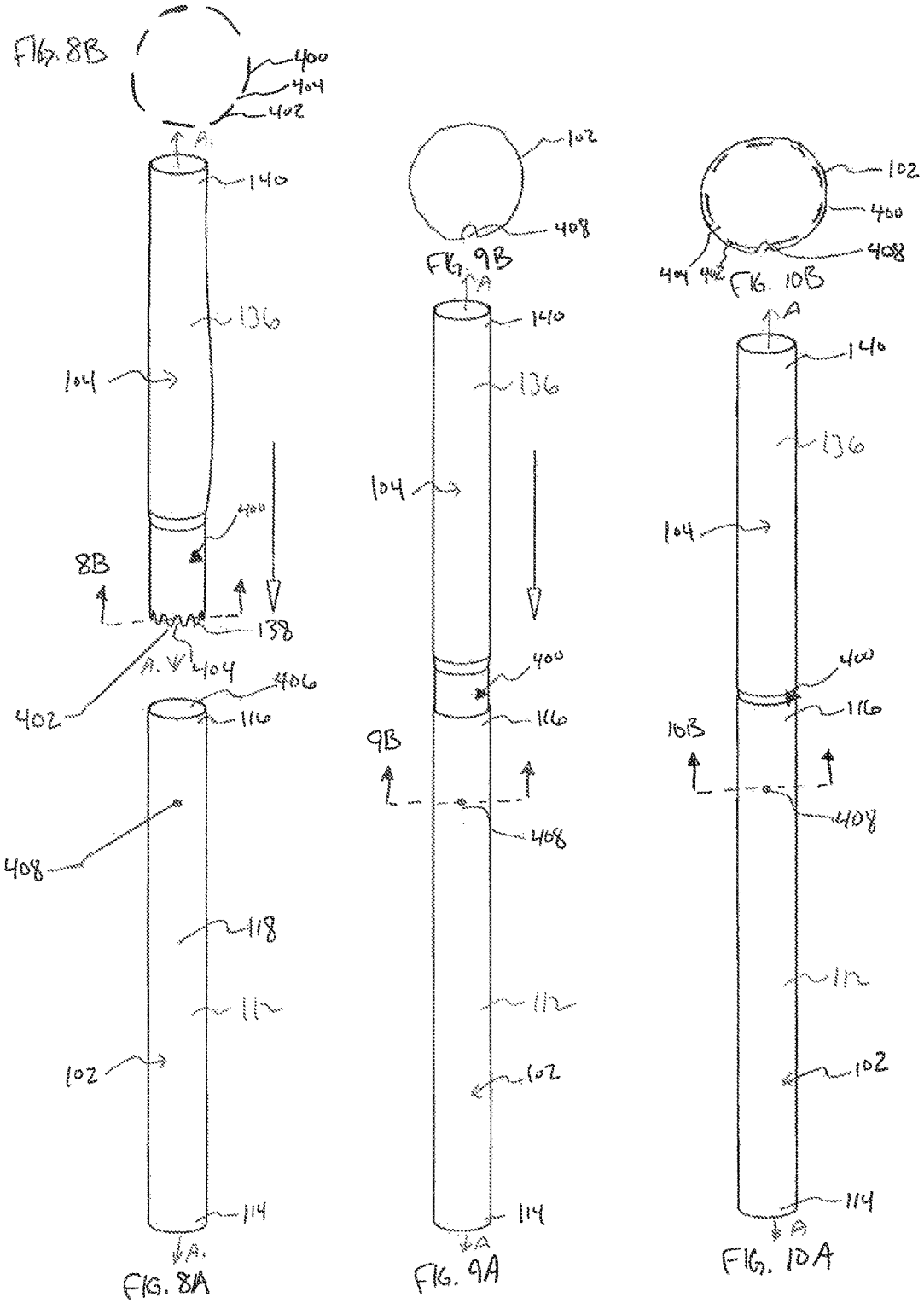
FIG. 8A is a perspective view of two modular artificial tree trunk sections shown in separation, according to an embodiment.
FIG. 8B is a cross-sectional view of the two tree trunk sections of FIG. 8A along the axis indicated in FIG. 8A, according to an embodiment.
FIG. 9A is a perspective view of the two modular artificial tree trunk sections of FIG. 5A shown in partial engagement, according to an embodiment.
FIG. 9B is a cross-sectional view of the two tree trunk sections of FIG. 8A along the axis indicated in FIG. 9A, according to an embodiment.
FIG. 10A is a perspective view of the two modular artificial tree trunk sections of FIG. 8A shown in complete engagement, according to an embodiment.
FIG. 10B is a cross-sectional view of the two tree trunk sections of FIG. 8A along the axis indicated in FIG. 10A, according to an embodiment.

In an embodiment, referring to FIG. 8A and cross-sectional view FIG. 8B, insertable portion 400 comprises a plurality of teeth 402 and channels 404 to create a saw-toothed edge. An individual tooth 402 is formed by a section of the edge of the circumference of the circle of insertable portion 400 and angled toward upper end 140 to define a V-shape. Channel 404 is immediately adjacent a first tooth 402 and defined by a void similar to the V-shape of the immediately adjacent first tooth 402, bit configured so that the points of the tooth 402 and channel 404 are pointed opposite each other. Immediately adjacent channel 404 is a second tooth 402, and immediately adjacent the second tooth 402 is a second channel 404, and so on. The edges of the channels 404 thereby define the edges of adjacent teeth 402. Insertable portion 400 therefore comprises a series of teeth 402 and channels 404 around the entire circumference of the circle of insertable portion 400. As in the embodiments described above, insertable portion can comprise a greater or lesser number of teeth 402 and channels 404. The relative depth of teeth 402 and channels 404 into the body of insertable portion 400 can be greater or less than the depth depicted, in other embodiments.

In an embodiment, first portion 102 comprises a receiving end 406 and one or more protuberances 408. Receiving end 406 is substantially similar to receiving end 306, and thereby comprises an end of first trunk portion 102 and is substantially formed by the inner walls of the body of first trunk portion 102. Receiving end 406 is adapted to receive insertable portion 400 of second trunk portion 104. As such, the outer dimensions of insertable portion 400 are shaped just smaller than the inner dimensions of first trunk portion 102, and specifically, receiving end 406. Specifically, the walls of insertable portion 400 are configured to make flush contact with a respective inner side of first trunk portion 102 at receiving end 406.

Protuberance 408 is substantially similar to protuberance 308 and projects inwardly from a location on outside wall 118 toward an opposite (inner) side of outside wall 118. In an embodiment, protuberance 308 comprises a convex point. In other embodiments, other shapes or projections are also considered, depending on the shape and cut-out depth and size of channels 404. Protuberance 408 is configured to engage or fill the aperture created between two teeth 402 by one of channels 404 on second trunk portion 104. In embodiments, receiving end 406 can comprise a plurality of protuberances 408 positioned accordingly along the circumference of outside wall 118 in relative alignment with channels 404 of second trunk portion 104.

In operation, first trunk portion 102 and second trunk portion 104 are assembled via coupling of insertable portion 400 and receiving end 406 substantially similar to the assembly described above with respect to insertable portion 200 and receiving end 206. Referring to FIGS. 9A and 9B, when insertable portion 400 is roughly halfway inserted and in partial engagement with first trunk portion 102, the most distal edge (teeth 402) have not yet contacted protuberance 408, as depicted in the cross-sectional view of FIG. 9B across outside wall 118 at protuberance 408.

In such an embodiment, once the furthermost edge of second trunk portion 104 via tooth 402 contacts protuberance 408, the user can rotate second trunk portion 104 such that one of channels 404 aligns with protuberance 408 while the majority of insertable portion 400 is inserted into receiving end 406 just as the embodiment of FIGS. 5A-7B, compared to the embodiment depicted in FIGS. 2A-4B, where alignment occurred with the majority of insertable portion 200 not yet inserted into receiving end 206. In embodiments, by having additional teeth 402 and adjacent channels 404, less rotation is required of second trunk portion 104 or first trunk portion 102 to align protuberance 408 with a particular channel 404 when compared to the above-described embodiments. Once so aligned, insertable portion 400 can be pushed past protuberance 408 along the axis formed by the trunk portions 102 and 104, as depicted by FIGS. 10A and 10B.

Figure 11:
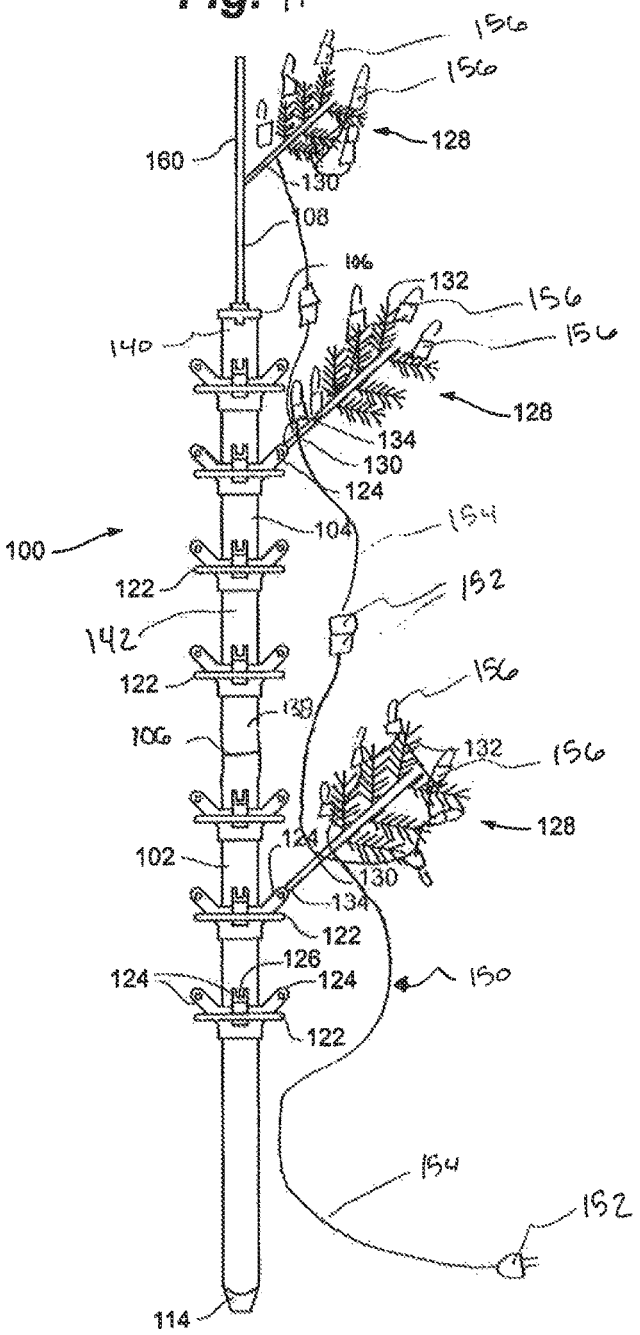
FIG. 11 is a front view of an artificial tree with locking trunk sections having light strings coupled to the tree branches, according to an embodiment.

The above embodiments of trunk portions are therefore useful for implementation in lighted or non-lighted trees once assembled via the described assemblies. Referring to FIG. 11, the artificial tree 100 of FIG. 1 is depicted with multiple light strings 150 draped around branches 128.

Light string 150 comprises an electrical power plug 152, a wire harness 154, and a plurality of lamps 156. Electrical power plug 152 electrically connects the light string to an external power source. Wire harness 154 electrically connects the power plug 152 to the plurality of lamps 156. The plurality of lamps 156 provides the illumination for light string 150, and can be incandescent bulbs, light-emitting diodes, a combination thereof, or any of other known types of light-emitting elements.

In other embodiments, the locking trunk portions of coupling mechanism 106 and its equivalents as described above are useful in pre-lit or lighted artificial trees.

Figure 12:
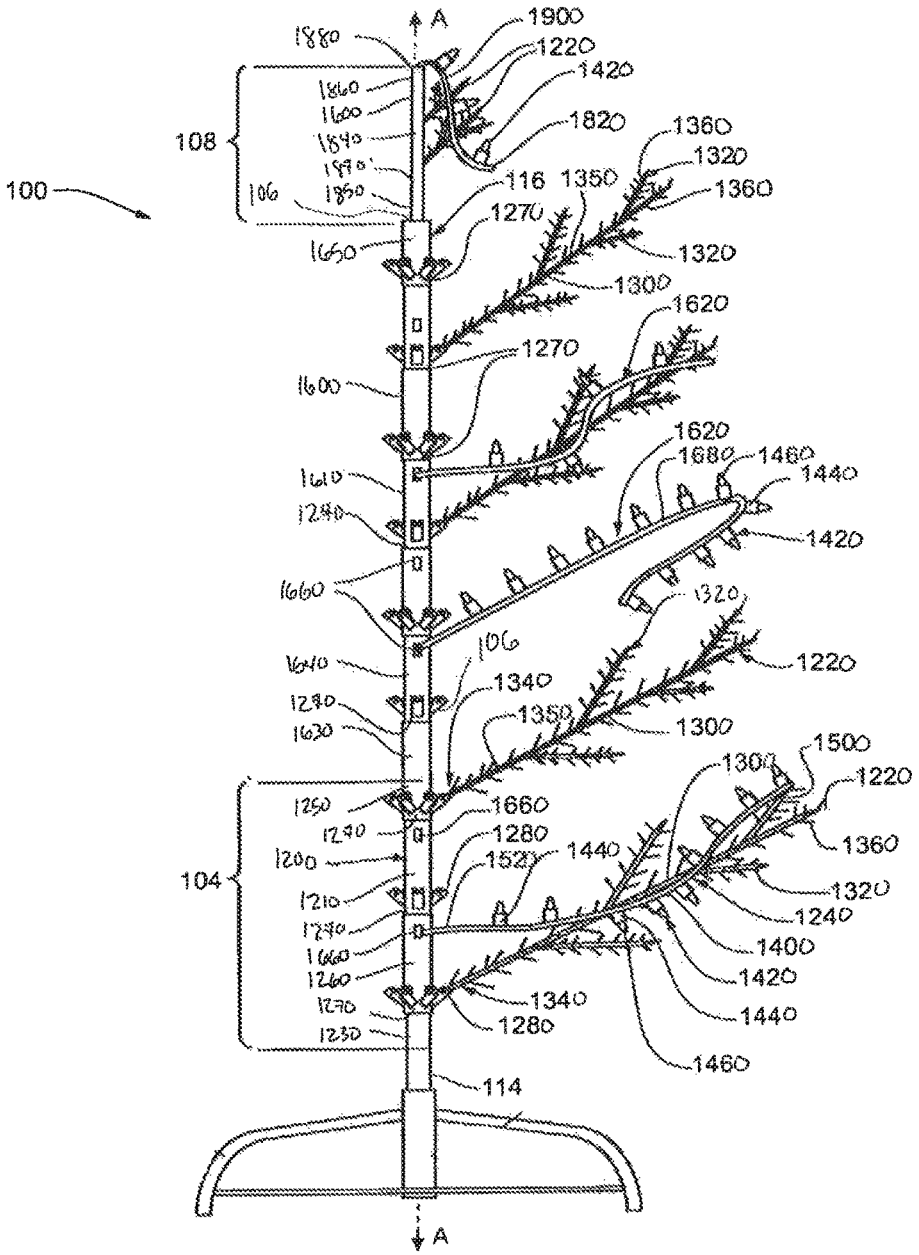
FIG. 12 is a front view of a lighted, artificial tree with locking trunk sections, according to an embodiment.

Referring to FIG. 12, modular tree 1000 is depicted in an assembled configuration, with multiple branches and light strings removed for illustrative purposes. Assembly of modular tree 1000 can be by operation of coupling mechanism 106 as described above for the respective modular portions of the modular tree 1000.

As depicted, first lighted tree portion 1040 includes first trunk portion 1200, multiple branches 1220, and one or more first light strings 1240.

First trunk portion 1200 as depicted comprises a generally cylindrical, hollow structure including trunk body 1210 having a first end 1230, second end 1250, outside wall 1260, and one or more branch-support rings 1270. First trunk portion 1200 also defines multiple openings 1660 in wall 1260. First trunk portion 1200 further comprises a receiving end (not shown) similar to that of first trunk portion 102, as discussed above.

Branch-support rings 1270 include multiple branch receivers 1280 extending outwardly and away from trunk portion 1200. In some embodiments, branch receivers 1280 define a channel for receiving a trunk end of a branch 1220.

Each branch 1220 generally includes primary branch extension 1300 and may also include multiple secondary branch extensions 1320 extending away from branch extension 1300. Branch 1220 is connected to trunk portion 1200 at a branch receiver 1280 at trunk-end 1340. In some embodiments, as depicted, branches 1220 include strands 1360 simulating the needles found on natural pine or coniferous trees. Strands 1360 are attached to branch frame 1350, which in some embodiments comprises a solid-core frame, such as a metal rod, wire, multiple twisted wires or rods, or similar such materials. In other embodiments, frame 1350 may be hollow.

Trunk ends of branches 1220 may be bent or otherwise formed to define a loop or circular opening such that trunk end 1340 of branch 1220 may be secured to branch receiver 1280 by way of a pin (not depicted) extending through branch receiver 1280 and the loop formed at trunk end 1340 of branch 1220. In this way, a branch 1220 may be allowed to pivot about the pin and branch receiver 1280, allowing tree portion 1040 to collapse to a smaller envelope size for convenient storage.

First light string 1240 includes light string wiring 1400 and a plurality of lighting element assemblies 1420. Each lighting assembly element 1420 includes housing 1440 and lighting element 1460. Lighting elements 1460 may comprise incandescent bulbs, light-emitting diodes, a combination thereof, or any of other known types of light-emitting elements.

Lighting elements 1460 may be electrically connected in parallel, series, or a combination of series and parallel, to form a parallel-connected, series-connected, parallel-series connected, or series-parallel connected first light string 1240.

First light string 1240 is affixed to one or more branches 1220 of lighted tree portion 1040 via multiple clips 1500. A proximal end 1520 of light string 1240 may be connected to outside wall 1260 of first trunk portion 1200 by a connector or clip as described further below, or may be inserted through an opening 1660 in wall 1260 into an interior space defined by first trunk portion 1200.

In one embodiment, first lighted tree portion 1040 includes a plurality of first light strings 1240. Such first light strings 1240 may be substantially the same, for example, a series-parallel connected light string having lighting element assemblies 1420. In other embodiments, first lighted tree portion 1040 may include first light strings 1240 having a particular configuration and other first light strings 1240 having another, different configuration. For example, first light strings 1240 located closer to base portion 1020 may be longer in length with more light emitting assemblies 1420, while first light strings 1240 further from base portion 1020 may be relatively shorter in length, with fewer light emitting assemblies 1420. In other embodiments, first lighted tree portion 1040 may include only a single light string 1240.

Second lighted tree portion 1060, adjacent first lighted tree portion 1040, is similar to lighted tree portion 1040 and includes second trunk portion 1600, multiple branches 1220 and one or more second light strings 1620.

Second trunk portion 1600 as depicted also comprises a generally cylindrical, hollow structure including trunk body 1610 having a first end 1630, a second end 1650, outside wall 1640, and one or more branch-support rings 1270. First trunk portion 1200 also defines multiple openings 166 in wall 1640. Second trunk portion 1600 further comprises an insertable portion (not shown) similar to insertable portion 200, 300, or 400 as elements of coupling mechanism 106.

Similar to first light strings 1240, second light strings 1620 may comprise any combination of series-connected or parallel-connected individual or groupings of lighting element assemblies 1420.

Third lighted tree portion 1080, adjacent to second lighted tree portion 1060 includes third trunk portion 1800, branches 1220, and one or more third light strings 1820. In some embodiments, such as the depicted embodiment, a diameter of third trunk portion 1800 may be somewhat smaller in diameter than a diameter of second lighted tree portion 1080. As depicted, third trunk portion 1800 comprises a relatively smaller diameter pipe-like body portion 1840 including lower end 1850, upper end 1860, trunk wall 1870, and defining top opening 1880. Also as depicted, in some embodiments, third trunk portion 1800 may also not include branch support rings 1270, as branches 1220 of third lighted tree portion 1080 may be somewhat shorter in length than branches 1220 of second lighted tree sections 1060 and may be directly connected to body portion 1840 of third trunk portion 1800. Third lighted tree portion further comprises portions of coupling mechanism 106 as described above.

Third light string 1820 includes wiring 1900 and multiple lighting element assemblies 1420. Similar to first light strings 1240, third light strings 1820 may comprise any combination of series-connected or parallel-connected individual or groups of lighting element assemblies 1420.

In the embodiment depicted, third light string 1820 emerges from top opening 1880 such that a portion of third light string 1820 is within an interior space defined by third trunk portion 1800. Alternatively, third light string 1820 may be connected via an electrical connector at opening 1880. In other embodiments, third light string is mechanically connected to trunk portion via a connector at wall 1860 of third trunk portion 1800, or may be received in part by an opening (not depicted) in wall 1860. In yet other embodiments, third light string 1820 may be an extension of second light string 1620.

Figure 13:
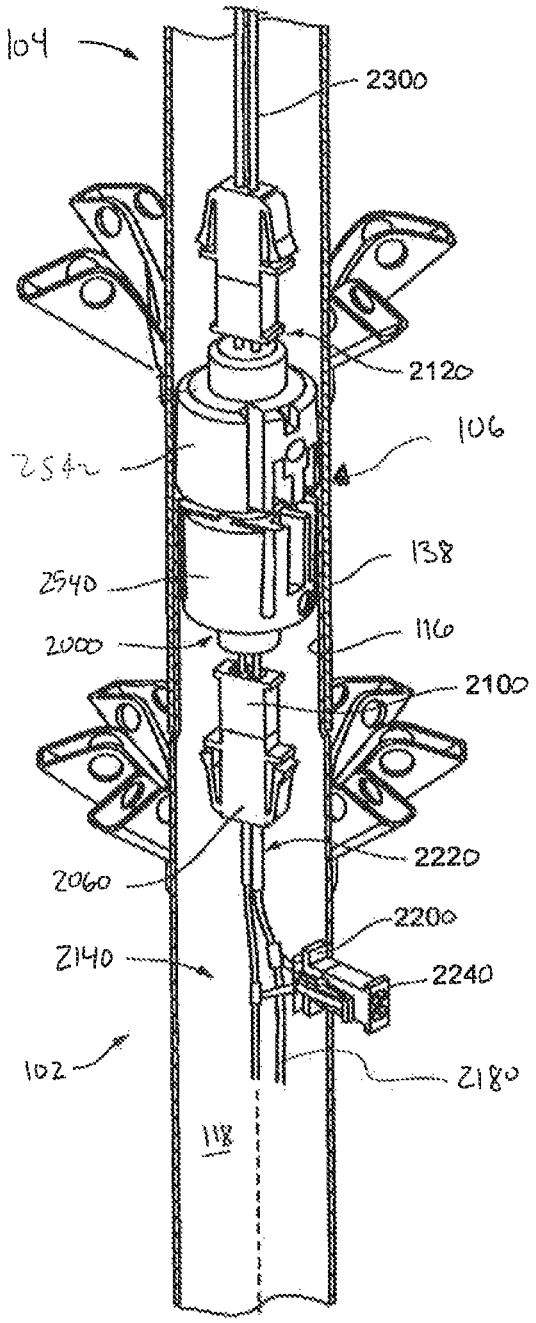
FIG. 13 depicts an electrical connection system assembled into trunk portions of the tree of FIG. 12, according to an embodiment.

Referring to FIG. 13, in an embodiment, tree 100 with locking trunk 101 includes internal electrical connectors and a wiring harness. First trunk portion 102 houses trunk electrical connector assembly 2000 comprising electrical connector 2540 and wiring harness 2220. Second trunk portion 104 houses trunk electrical connector assembly 2120 comprising electrical connector 2542 and wiring harness 2300. Embodiments of the electrical connectors and wiring harnesses are also depicted and described in pending U.S. patent application Ser. No. 13/112,650, entitled MODULAR LIGHTED TREE, and published as U.S. Pat. Pub. No. 2012/0076957, the contents of which are herein incorporated by reference in its entirety.

Figure 14:
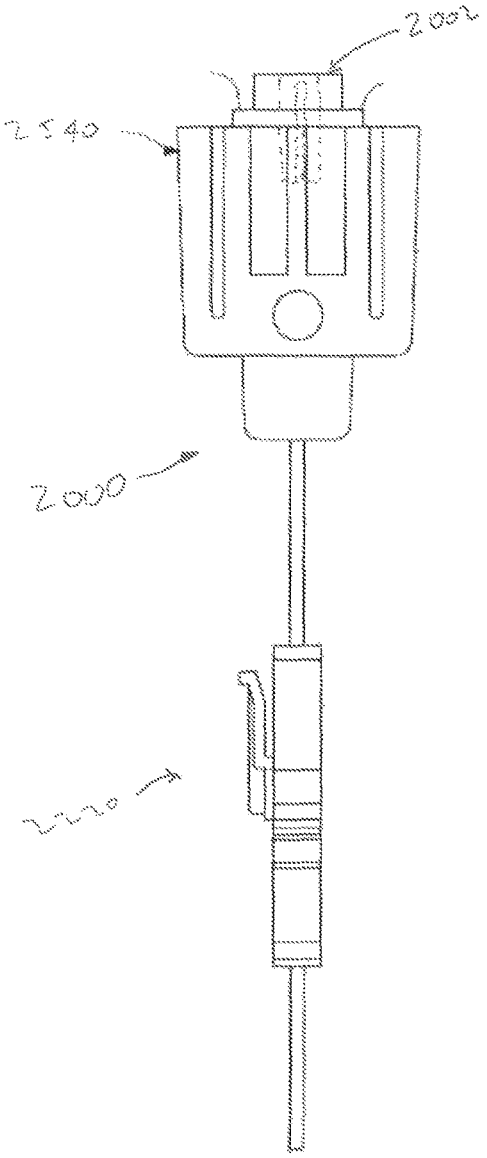
FIG. 14 depicts a first portion of an embodiment of an electrical connector of the electrical connection system of FIG. 13.

Referring also to FIG. 14, in an embodiment, electrical connector 2540 comprises female trunk electrical connector portion 2002 having a pair of electrical terminals and configured to receive male counterpart 2004 of electrical connector 2542 (see also FIG. 15), having a pair of electrical terminals, to form a coaxial-like electrical connection. Trunk connector assembly 2000 is inserted into upper end 116 first trunk portion 102. Wiring harness 2220 when connected to trunk connector assembly 2000 extends through a portion or all of the interior of first trunk portion 102. In an embodiment, wiring harness 2020 includes optional electrical connector 2060. Wiring harness 2020 may also include light string connector 2240 attached to trunk body 118

Figure 15:
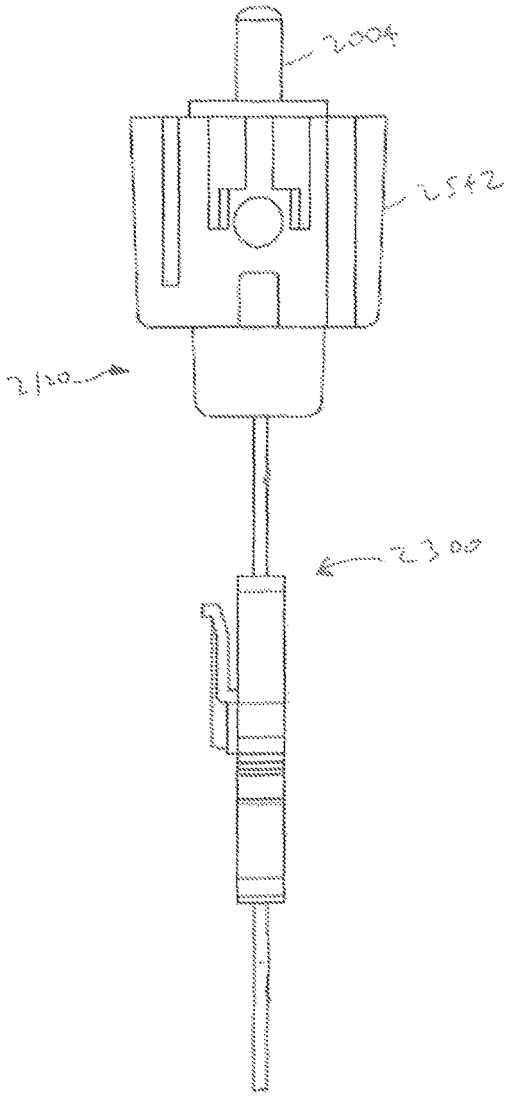
FIG. 15 depicts a second portion of an embodiment of an electrical connector of the electrical connection system of FIG. 13.

Referring to FIG. 13 and FIG. 15, second trunk portion 104 houses trunk connector assembly 2120, including electrical connector 2542 and trunk wiring harness 2300. In one embodiment, such as the embodiment depicted, trunk connector assembly 2120 is a male trunk connector configured to be inserted into a female counterpart, to form a coaxial-like electrical connection. Trunk connector assembly 2120 is inserted into lower end 114 of trunk body 112. Trunk connector assembly 2000 is inserted into upper end 116 of trunk body 112.

When second trunk portion 104 is coupled and connected to first trunk portion 102 via operation of coupling mechanism 106, strunk wiring harness 2300 is in electrical communication with wiring harness 2220. Consequently, light strings of the second trunk portion 104 are in electrical communication with light strings of the first trunk portion 102 via trunk wiring harnesses 2220 and 2300.

FIG. 13 also depicts first trunk wiring harness 2140 connected at connector 2060 to connector assembly 2000 and to trunk body 118. A connector 2240 of a light string connects the light string and its lighting elements to first trunk wiring harness 2140 and consequently to connector assembly 2000.

The embodiments of electrical connectors of FIGS. 13-15 described and depicted above can generally be connected in any rotational orientation or alignment. This is due, in part, to their coaxial nature. Electrical connectors 2540 and 2542 fit together to make an electrical connection between trunk portions 102 and 104 independent of any rotational orientation. On the other hand, trunk portion 102 must be aligned with trunk portion 104 such that a channel 204 is aligned with convex point 208 in one of a limited number of rotational orientations or alignments. The universal rotational alignment of the electrical connectors 2540 and 2542 provides the advantage that connectors 2540 and 2542 may be inserted in any orientation during manufacturing assembly, and further, when a user aligns trunk portions 102 and 104 to join the trunk portions, it is only necessary to align trunk bodies, and not electrical connectors.

Consequently, in an embodiment, the tree of the claimed invention comprises locking trunk sections that require a particular alignment of the trunk bodies to be coupled, and internal electrical connectors that do not require any particular rotational alignment to couple with one another and make an electrical connection between tree or trunk sections.

Other embodiments of electrical connectors that may be connected independent of any relative rotational orientation may also be included in the claimed invention. Examples of such embodiments, including both 2-wire, 4-wire, 5-wire, and more are depicted and described in U.S. Application No. 61/643,968, entitled MODULAR TREE WITH ELECTRICAL CONNECTOR.

In other embodiments, tree 100 utilizes locking electrical connectors, rather than electrical connectors that connect independent of any rotational orientation, such as those described above in FIGS. 13-15. Locking electrical connectors supplement the anti-rotational features of locking trunk 101, ensuring that trunk portions 102 and 104 do not rotate, or rotate only minimally.

In one such embodiment, the body of female electrical connector 2540 includes a plurality of teeth, and define a plurality of teeth-receiving recesses between each tooth. Each tooth includes angled sides.

In an embodiment, the body of male electrical connector 2542 includes a plurality of teeth, and defines a plurality of teeth-receiving recesses between each tooth. Each tooth includes angled sides.

When female electrical connector 2540 is coupled to male electrical connector 2542, each tooth of female electrical connector fits into a tooth-receiving recess of male electrical connector 2120. Similarly, each tooth of male electrical connector 2542 fits into a tooth-receiving recess of female electrical connector 2540.

When connectors 2540 and 2542 are fit tightly into their respective trunk portions, and the trunk portions are coupled together, connector 2540 cannot rotate relative to connector 2542, not only because of the locking features of trunk 101, but also because of the additional locking or coupling of the electrical connectors. In other words, when female electrical connector 2540 and male electrical connector 2542 are aligned, and when coupled together, the connectors are not able to rotate relative to one another.

As such, connectors 2540 and 2542 may be coupled in any one of a plurality of rotational positions relative to one another, but once they are coupled, the connectors cannot rotate. Such a feature allows a user to easily assemble one tree section to another tree section without having to be concerned with a rotational alignment of the two tree sections. At the same time, once the tree sections are joined, the tree sections will not rotate, which provides both safety and aesthetic advantages. Therefore, once trunk sections 102 and 104 are also locked via operation of coupling mechanism 106 and its equivalents as described above, redundancy to internal system mating connectors is provided.

Figure 16:
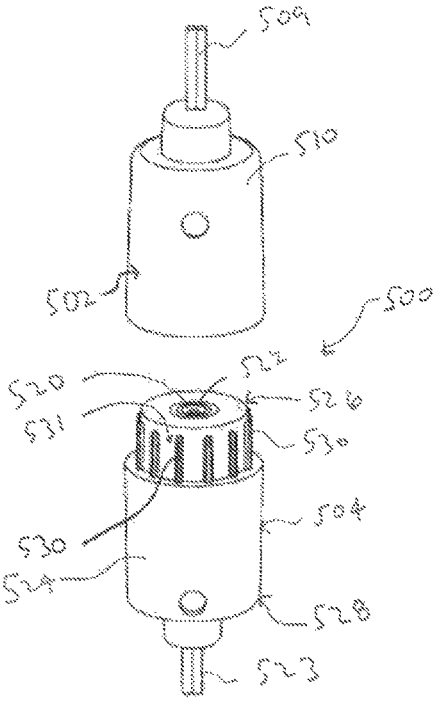
FIG. 16 depicts a locking electrical connector system according to an embodiment.
Figure 17:
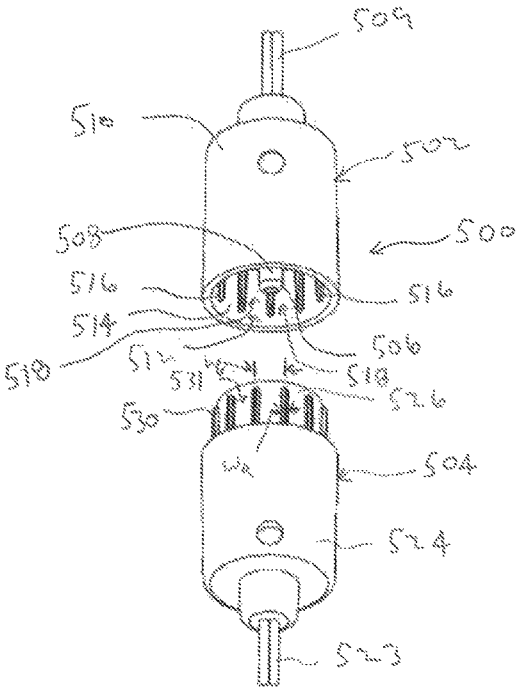
FIG. 17 depicts another perspective view of the locking electrical connector system of FIG. 16.

Another embodiment of a limited rotation set of electrical connectors 500 is depicted in FIGS. 16 and 17. In this embodiment, electrical connector set 500 includes first electrical connector 502, which in an embodiment includes a male portion, and second electrical connector 504, which in an embodiment includes a female portion.

Electrical connector 502 includes electrical terminal set 506, which in an embodiment, comprises a male portion 508, and which are electrically connected to wires 509. In an embodiment, a first electrical terminal is at a tip of male portion 508, and a second electrical terminal is in the interior of male portion 508. However, the claimed invention may include any configuration of electrical terminals, including the electrical terminals as described above with respect to FIGS. 14 and 15 and the incorporated reference.

Electrical connector 502 also includes body portion 510 defining recess 512 and inside surface 514, and ridges 516. Ridges 516 are distributed about inside surface 514, extending in a generally vertical, or top to bottom direction. Gaps 518 are defined between ridges 516.

Electrical connector 504 includes female portion 520 with electrical terminal set 522, similar to the "female" portion 2002 described above with respect to FIG. 14, and electrically connected to wires 523. Electrical connector 504 also includes body portion 524 defining terminal end 526 and wire end 528. Terminal end 526, in an embodiment, and as depicted, includes ridges 530, defining gaps 531, and has a diameter equal to, or slightly less than an inside diameter of connector 502, such that terminal end 522 can be fit into recess 512.

When electrical connectors 502 and 504 are coupled together, terminal end 522 of electrical connector 504 is fit into recess 512 of electrical connector 502, and male portion 508 is fit into female portion 520. The coupling of the connectors 502 and 504 causes electrical terminals 508 and 522 to be electrically connected such that wire sets 509 and 523 are also electrically connected.

Further, when electrical connectors 502 and 504 are coupled together, ridges 530 of electrical connector 504 are aligned with, or located in, gaps 518 of electrical connector 502; ridges 516 of electrical connector 502 are likewise aligned with gaps 531 of electrical connector 504. In the embodiment depicted, ridges 516 and 530 have widths, $W_R$ that are less than the widths $W_G$ of their respective gaps, such that electrical connectors 502 and 504 could rotate somewhat relative to each other. In such an embodiment, the degree of rotation is dependent upon the number of ridges and gaps, and their relative widths. Generally, more gaps and ridges results in less possible relative rotation. Also, the closer the width of the ridges to the gaps, the less rotation possible. In other words, if the ridges and gaps have approximately the same width, such that the ridge fills the gap, essentially no relative rotational movement would be possible.

In an embodiment, each electrical connector 502 and 504 have six ridges defining six gaps. In another embodiment, each electrical connector 502 and 504 have more than six ridges and more than five gaps; In one such embodiment, the connectors have 10 or 12 ridges and 10 or 12 gaps. In another embodiment, the connectors have fewer than six ridges and six gaps.

With respect to ridge and gap widths, a variety of widths are included in the claimed invention. In one embodiment, the ridges have a width $W_R$ that is less than the width $W_G$ of the gaps; in one such embodiment, the width of each of the ridges is less than half the width of the gaps; in another such embodiment, the width of each of the ridges is less than 25% of the width of the gaps. In another embodiment, width $W_R$ is substantially equal to width $W_G$. In such an embodiment, ridges would have to be perfectly aligned with gaps for the two electrical connectors to fit together. Such an embodiment would make it potentially harder for a user to align the connectors as compared to an embodiment having ridge widths $W_R$ that are smaller than gap widths $W_G$.

Although in an embodiment all ridge widths for a given electrical connector are substantially the same, in other embodiments, ridge widths could vary from ridge to ridge. In one embodiment, a single ridge could be larger than the other ridges, and meant to fit into a particular gap having a width larger than the other gaps, thereby creating a sort of one-way keyed connection.

For the majority of embodiments described above, electrical connector 502 and 504 may be coupled in one of many possible relative rotational alignments. For example, when the electrical connectors have six ridges and six gaps, at least six rotational alignments are possible (any single ridge fitting into any of the gaps). When gap widths WG are greater than ridge widths WR, some rotational movement between the electrical connectors 502 and 504 is possible. For such embodiments, each rotational alignment position has a predetermined range of motion. Having some range of motion for electrical connectors 502 and 504 may be useful when aligning the trunk sections 102 and 104.

In an embodiment of a circular electrical connector set 502 and 504, the maximum RRM for any particular rotational alignment may be defined as substantially equal to the smallest width $W_G$ of any gap. In an embodiment, width WG may be defined in arc length and/or in degrees of rotation.

Figure 18:
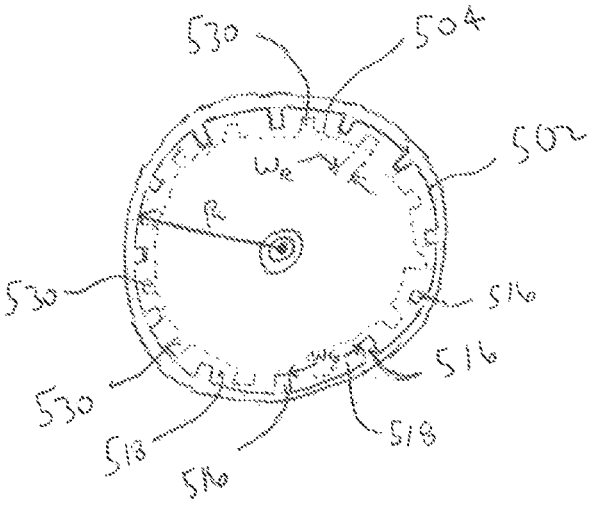
FIG. 18 depicts a top view of an electrical connector according to an embodiment.

FIG. 18 depicts a top view of connector 502. Gap width $W_G$ of a gap 518 may be measured as an arc length between two ridges 516. In the embodiment depicted, electrical connector 502 includes 12 ridges 516, distributed about an inside surface 512 of electrical connector 502; electrical connector 504, depicted in dotted line, also includes 12 ridges, ridges 530, each having the same ridge width $W_R$ An inside radius of electrical connector 502 is defined as radius R.

In an embodiment, all gaps 518, and therefore all gap widths $W_G$ are substantially the same size. In other embodiments, gaps 518 may be of different sizes, or widths, with one or more gaps 518 defining the smallest gap width $W_G$.

In an embodiment, ridges 530 may all have substantially the same width WR. In other embodiments, ridges 530 may have different widths, some larger than others.

Generally, the relative range of motion of electrical connector 502 with respect to electrical connector 504 (RRM) can be considered the range of motion of a ridge 530 in a gap 518. More specifically, the relative range of motion is substantially the width of a gap 518 less the width of a ridge 530 located in the gap 518, or $RRM=W_G-W_R$. For circular connectors, such as those depicted, RRM can also be expressed in degrees of rotation as $RRM=360\ \text{degrees}\times((W_G-W_R)/2\pi R)$.

In an embodiment, R is 1 inch, the inner circumference of electrical connector 502 is 6.28 inches, the smallest gap width is 0.50 inches, and ridge width WR in the gap is 0.023 inches. The RRM in degrees is 27.34 degrees. In other words, electrical connector 502 and 504, if not constrained by trunk 101, could rotate up to 27.34 degrees relative to one another.

A relative range of motion for a set of electrical connectors of the claimed invention may range from 360 degrees for universal connectors such as 2000 and 2120, to 0 degrees for locking connectors having ridges and gaps with equal widths (no movement of ridge in gap). In an embodiment, locking electrical connectors have a rotational range of movement of 0 degrees to 180 degrees, allowing for substantial rotational movement. In another embodiment, the relative range of movement ranges from 0 degrees to 60 degrees. The larger the RRM, the less precisely the two electrical connectors must be rotationally aligned.

A similar determination for RRM for trunk sections 102 and 104, in which convex point 208 can move along an arc length within channel 204. In such a determination, convex point 208 is analogous to a ridge 530, and channel 204 is analogous to a gap 518.

In an embodiment, the relative range of motion of the electrical connectors is greater than a relative range of motion of a pair of corresponding trunk bodies, such that the RRM of the trunk bodies is more limiting that the RRM of the electrical connectors.

In another embodiment, trunk sections 102 and 104 may not include any channels or "sawtooth" structure, and tree 100 may rely entirely upon the locking features of its electrical connectors, such as locking electrical connectors 502 and 504. In such an embodiment, the RRM of the trunk bodies is 360 degrees since without the electrical connectors they may be coupled in any rotational orientation or alignment, and such that the RRM of the trunk bodies that house the electrical connectors is greater than the RRM of the locking electrical connectors.

During manufacturing assembly, electrical connector 502 is inserted into trunk section 102, and electrical connector 504 is inserted and secured in trunk section 104, in a manner substantially described above with respect to FIG. 13. During manufacturing assembly, electrical connectors 502 and 504 must be rotationally aligned with their respective trunk ends so that the trunk bodies can be aligned with one another, and connectors 502 and 504 can be aligned with one another. For example, referring also to FIG. 3A, when channels 204 are aligned with convex point 208, gaps 518 align with ridges 530 (and gaps 531 align with ridges 516).

Further in an embodiment, and as described in part above, the rotational range of movement RRM in degrees of the electrical connectors may be greater than a similar range of movement of the metal trunk sections, determined by the relative size of the convex point as compared to channel 204, such that the alignment of the trunk sections is more critical than the alignment of the electrical connectors. In such an embodiment, the alignment of locking electrical connectors 502 and 504 within their respective trunk sections becomes less important as the rotational alignment of the trunks if smaller, and therefore, more precise. This aids in the manufacturing process, and aids the user in assembly tree sections. Further, should the mechanical locking features of the trunk bodies alone fail or otherwise diminish, the locking features of the electrical connectors would provide further assurances that rotation between trunk sections would be minimized.

Further, although locking electrical connectors 502 and 504 are described as having ridges and gaps, in other embodiments, locking electrical connectors 502 and 504 may comprise other projection and recess features, rather than simply "ridges" and "gaps".

Various embodiments of systems, devices and methods have been described herein. These embodiments are given only by way of example and are not intended to limit the scope of the invention. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the invention.

Persons of ordinary skill in the relevant arts will recognize that the invention may comprise fewer features than illustrated in any individual embodiment described above. The embodiments described herein are not meant to be an exhaustive presentation of the ways in which the various features of the invention may be combined. Accordingly, the embodiments are not mutually exclusive combinations of features; rather, the invention may comprise a combination of different individual features selected from different individual embodiments, as understood by persons of ordinary skill in the art.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims for the present invention, it is expressly intended that the provisions of Section 112, sixth paragraph of 35 U.S.C. are not to be invoked unless the specific terms "means for" or "step for" are recited in a claim.

The invention claimed is:

1. A tree trunk system for an artificial decorative tree, comprising:

a first trunk body including a trunk wall, distal end and a proximal end, and defining a first central axis extending from the distal end to the proximal end, the distal end having an insertable portion formed of the trunk wall and defining one or more axially-extending channels spaced circumferentially about the insertable end; and a second trunk body including a distal end and a hollow proximal end, and defining a second central axis extending from the distal end to the proximal end, the proximal end configured to receive the insertable portion of the first trunk body and having a protuberance extending radially inward;

wherein the protuberance of the second trunk body aligns with, and fits into one of the one or more channels of the first trunk body when the first trunk body and the second trunk body are aligned on a common central axis, and the end portion of the first trunk body is inserted into the proximal end of the second trunk body, thereby preventing or minimizing rotation of the first trunk body relative the second trunk body, about the common central axis.

2. The tree trunk system of claim 1, wherein the insertable end of the first trunk body when viewed in cross section defines a continuous circumferential edge.

3. The tree trunk system of claim 1, wherein the proximal end of the first trunk body defines an outside diameter that is greater than an outside diameter of the distal end of the first trunk body.

4. The tree trunk system of claim 1, wherein each of the one or more channels extend axially along at least 90% of a length of the insertable portion.

5. The tree trunk system of claim 1, wherein the second trunk body includes a plurality of protuberances, each protuberance configured to be received by one of the plurality of channels of the first trunk body.

6. A lighted artificial tree, comprising:

a first tree portion including:

a first trunk body having a trunk wall, distal end and a proximal end, and defining a first central axis extending from the distal end to the proximal end, the distal end having an insertable portion formed of the trunk wall and defining one or more channels;

a first electrical connector positioned in the distal end of the first trunk body;

a first wiring harness electrically connected to the first electrical connector and having wires extending axially within the first trunk body and away from the first electrical connector; and a first light string electrically connected to the wires of the first wiring harness; and a second tree portion including:

a second trunk body including a distal end and a hollow proximal end, the proximal end configured to receive the insertable portion of the first trunk body along a common central axis and having a protuberance, the protuberance configured to be received by the one or more channels of the first trunk body;

a second electrical connector configured to electrically connect with the first electrical connector independently of a relative rotational alignment of the first electrical connector and the second electrical connector about the common central axis, the second electrical connector positioned in the proximal end of the second trunk body and;

a second wiring harness electrically connected to the second electrical connector and having wires extending axially within the second trunk body and away from the first electrical connector;

wherein the first trunk body when coupled to the second trunk body cannot rotate relative to the second trunk body about the common central axis, and the first electrical connector is electrically connected to the second electrical connector.

7. The lighted artificial tree of claim 6, wherein the first trunk body couples to the second trunk body in any one of a plurality of predetermined rotational orientations.

8. A lighted artificial tree, comprising:

a first tree portion including:

a first trunk body having a trunk wall, a distal end and a proximal end, and defining a first central axis extending from the distal end to the proximal end, the trunk wall at the distal end having an insertable portion formed of the trunk wall and defining one or more channels;

a first electrical connector positioned in the distal end of the first trunk body;

a first wiring harness electrically connected to the first electrical connector and having wires extending axially within the first trunk body and away from the first electrical connector; and a first light string electrically connected to the wires of the first wiring harness; and a second tree portion including:

a second trunk body including a distal end and a hollow proximal end, the proximal end configured to receive the insertable portion of the first trunk body along a common central axis and having a protuberance, the protuberance configured to be received by one of the one or more channels of the first trunk body, such that the first trunk body is connectable to the second trunk body in any one of a plurality of rotational coupling alignment positions;

a second electrical connector configured to electrically connect with the first electrical connector in one of a plurality of rotational coupling alignment positions of the first electrical connector relative the second electrical connector about the common central axis, the second electrical connector positioned in the proximal end of the second trunk body and;

a second wiring harness electrically connected to the second electrical connector and having wires extending axially within the second trunk body and away from the first electrical connector;

wherein when the first tree portion is coupled to the second tree portion, the first trunk body cannot rotate relative to the second trunk body about the common central axis, and the first electrical connector cannot rotate relative to the second electrical connector and the first electrical connector is electrically connected to the second electrical connector.

9. The lighted artificial tree of claim 8, wherein a number of available rotational alignment positions of the first electrical connector relative the second electrical connector is the same as, or more than, the number of available rotational alignment positions of the first trunk body relative the second trunk body.

10. The lighted artificial tree of claim 1, wherein the one or more channels comprises two channels.

11. The lighted tree of claim 1, wherein the protuberance comprises a convex bump projecting radially into an interior portion of the second trunk body.

12. The lighted tree of claim 1, wherein the protuberance is not at an edge of the proximal end of the second trunk portion.

13. The lighted tree of claim 1, further comprising:

a first electrical connector positioned in the distal end of the first trunk body;

a second electrical connector positioned in the proximal end of the second trunk body; and wherein when the first trunk body and the second trunk body are aligned on a common central axis, and the end portion of the first trunk body is inserted into the proximal end of the second trunk body, the first and second electrical connectors make electrical connection.

14. The lighted tree of claim 6, wherein the first electrical connector comprises a pair of electrical terminals coaxial about the common central axis.

15. The lighted tree of claim 6, wherein the protuberance comprises a convex bump projecting radially into an interior portion of the second trunk body.

16. The lighted tree of claim 6, wherein the protuberance is not at an edge of the proximal end of the second trunk portion.

17. The lighted artificial tree of claim 8, wherein the one or more channels comprises two channels.

18. The lighted artificial tree of claim 8, wherein the second trunk body comprises a plurality of protuberances, the plurality of protuberances configured to be received by the one or more channels of the first trunk body.

19. The lighted artificial tree of claim 8, wherein each of the first and the second electrical connectors includes a pair of electrical terminals.

* * * * *